US012722875B2

(12) United States Patent
Hodges et al.

(10) Patent No.: US 12,722,875 B2
(45) Date of Patent: Sep. 1, 2026

(54) PACKAGE

(71) Applicant: Nicoventures Trading Limited, London (GB)

(72) Inventors: Paul Hodges, London (GB); Stephen Lewis, London (GB); Thomas Allen, London (GB); Michael Churcher, London (GB); Isaak Mustafa, London (GB)

(73) Assignee: NICOVENTURES TRADING LIMITED, London (GB)

( * ) Notice: Subject to any disclaimer, the term of this patent is extended or adjusted under 35 U.S.C. 154(b) by 542 days.

(21) Appl. No.: 18/017,870

(22) PCT Filed: Jun. 30, 2021

(86) PCT No.: PCT/GB2021/051656
§ 371 (c)(1),
(2) Date: Jan. 25, 2023

(87) PCT Pub. No.: WO2022/023699
PCT Pub. Date: Feb. 3, 2022

(65) Prior Publication Data

US 2023/0278776 A1 Sep. 7, 2023

(30) Foreign Application Priority Data

Jul. 27, 2020 (GB) ..... 2011612

(51) Int. Cl.
*B65D 85/10* (2006.01)
*D21H 27/10* (2006.01)

(52) U.S. Cl.
CPC ..... *B65D 85/1045* (2013.01); *B65D 85/1027* (2013.01); *D21H 27/10* (2013.01);
(Continued)

(58) Field of Classification Search
CPC ..... B65D 85/1072; B65D 85/1045; B65D 85/1056; B65D 85/1036; B65D 85/10;
(Continued)

(56) References Cited

U.S. PATENT DOCUMENTS 1,895,932 A 1/1933 Koch
2,026,477 A 12/1935 Lescher
(Continued)

FOREIGN PATENT DOCUMENTS

CA 1279299 C 1/1991
CN 109153494 A 1/2019
(Continued)

OTHER PUBLICATIONS

International Search Report for corresponding application PCT/GB2021/051655 filed Jun. 30, 2021; Mail date Jan. 14, 2022.
(Continued)

*Primary Examiner* — Javier A Pagan
(74) *Attorney, Agent, or Firm* — CANTOR COLBURN LLP

(57) ABSTRACT

The present invention relates to a package (10) for an aerosol provision system component or an article. The package comprises a container (11) with an access (15), and an inner pack (20) located within the container such that the inner pack can be accessed via the access. The inner pack comprises a sheet material that is arranged to form the inner pack. The inner pack comprises a first end wall (22) proximate to the access and a second end wall (23) distal to the access longitudinally distant from the first end wall. The first end wall comprises first and second flaps (25, 26) of the sheet material which extend from opposing sides of the first end wall. The first and second end flaps of sheet material are
(Continued)

secured in position by an adhesive (29) configured to seal the inner pack. The present invention also relates to a method of manufacture of a package.

32 Claims, 11 Drawing Sheets

(52) U.S. Cl.
CPC .. *B65D 2565/382* (2013.01); *B65D 2565/385* (2013.01); *B65D 2565/387* (2013.01)

(58) Field of Classification Search
CPC .... B65D 85/08; B65D 85/07; B65D 85/1027; B65D 85/1018
See application file for complete search history.

(56) References Cited

U.S. PATENT DOCUMENTS

| | | | | |
|---|---|---|---|---|
| 2,041,679 | A | 5/1936 | Joseph | |
| 2,109,100 | A | 2/1938 | Brophy | |
| 2,283,102 | A | 5/1942 | Stephano | |
| 2,318,101 | A | 5/1943 | German | |
| 2,445,001 | A | 7/1948 | Pence | |
| 2,529,853 | A | 11/1950 | Taggart | |
| 2,690,288 | A | 9/1954 | Allen et al. | |
| 2,767,900 | A | 10/1956 | Michel | |
| 2,881,970 | A | 4/1959 | Hovland | |
| 2,984,384 | A | 5/1961 | Walker et al. | |
| 3,105,591 | A | 10/1963 | Ahlbor | |
| 3,108,711 | A | 10/1963 | Anton | |
| 3,245,525 | A | 4/1966 | Shoemaker | |
| 3,265,287 | A | 8/1966 | Hovland | |
| 3,333,683 | A * | 8/1967 | Scharre | B65D 75/68 229/87.13 |
| 3,727,828 | A | 4/1973 | Hall | |
| 4,300,676 | A | 11/1981 | Focke | |
| 4,375,260 | A | 3/1983 | Focke et al. | |
| D268,649 | S | 4/1983 | Adamson et al. | |
| 4,460,088 | A | 7/1984 | Rugenstein et al. | |
| 4,540,091 | A | 9/1985 | Haboeck | |
| 4,599,275 | A | 7/1986 | Hayashi et al. | |
| 4,789,060 | A | 12/1988 | Focke et al. | |
| 4,942,961 | A | 7/1990 | Focke et al. | |
| 4,949,841 | A | 8/1990 | Focke | |
| 5,018,625 | A | 5/1991 | Focke et al. | |
| 5,029,712 | A | 7/1991 | Obrien et al. | |
| 5,080,227 | A | 1/1992 | Focke | |
| 5,121,879 | A | 6/1992 | Focke et al. | |
| 5,127,148 | A | 7/1992 | Lykes et al. | |
| 5,301,804 | A | 4/1994 | Focke et al. | |
| 5,358,171 | A | 10/1994 | Focke | |
| 5,427,235 | A | 6/1995 | Powell | |
| 5,435,439 | A | 7/1995 | Swart | |
| 5,465,836 | A | 11/1995 | Focke | |
| 5,511,658 | A | 4/1996 | Focke et al. | |
| 5,577,612 | A | 11/1996 | Chesson et al. | |
| 5,634,556 | A | 6/1997 | Focke et al. | |
| 5,819,924 | A | 10/1998 | Sigrist et al. | |
| 6,000,539 | A | 12/1999 | Stewart-Cox | |
| 6,164,444 | A | 12/2000 | Bray et al. | |
| 6,237,760 | B1 | 5/2001 | Parker | |
| 6,318,625 | B1 | 11/2001 | Müller et al. | |
| 6,390,290 | B1 | 5/2002 | Focke et al. | |
| 6,726,014 | B2 | 4/2004 | Laurent | |
| 6,889,827 | B2 | 5/2005 | Stringfield | |
| 7,353,940 | B2 | 4/2008 | Sendo | |
| 7,395,924 | B2 | 7/2008 | Tambo | |
| 7,886,900 | B2 | 2/2011 | Weiss et al. | |
| 8,136,661 | B2 * | 3/2012 | Lutzig | B65D 85/1018 229/87.13 |
| D830,199 | S | 10/2018 | Ogata et al. | |
| 11,084,649 | B2 | 8/2021 | Chatelain et al. | |
| 2005/0130822 | A1 | 6/2005 | Rath | |
| 2007/0023301 | A1 | 2/2007 | Pham | |
| 2007/0193896 | A1 | 8/2007 | Tanbo et al. | |
| 2008/0308432 | A1 | 12/2008 | Lutzig et al. | |
| 2009/0308766 | A1 | 12/2009 | Polloni et al. | |
| 2011/0017762 | A1 * | 1/2011 | Emmett | B65D 85/1009 206/254 |
| 2014/0131234 | A1 | 5/2014 | Ghini | |
| 2016/0135499 | A1 | 5/2016 | Sebastian | |
| 2017/0356135 | A1 | 12/2017 | Biza | |
| 2019/0352041 | A1 | 11/2019 | Polloni | |
| 2019/0367235 | A1 | 12/2019 | Holford | |
| 2020/0002034 | A1 | 1/2020 | Polloni | |
| 2022/0340342 | A1 | 10/2022 | Knöös et al. | |

FOREIGN PATENT DOCUMENTS

| | | | | |
|---|---|---|---|---|
| CN | 108367860 | B | 10/2020 | |
| DE | 3632376 | A1 | 3/1988 | |
| EP | 0947442 | A1 | 10/1999 | |
| EP | 1813553 | A1 | 8/2007 | |
| EP | 2982607 | A1 | 2/2016 | |
| EP | 3464120 | A1 | 4/2019 | |
| EP | 3672877 | B1 | 5/2023 | |
| GB | 841314 | A | 7/1960 | |
| GB | 1501181 | A | 2/1978 | |
| JP | S50123900 | A | 9/1975 | |
| JP | S6264756 | A | 3/1987 | |
| JP | 2002500993 | A | 1/2002 | |
| JP | 2006142566 | A | 6/2006 | |
| JP | 2009292514 | A | 12/2009 | |
| JP | 2012502855 | A | 2/2012 | |
| JP | 2014210612 | A | 11/2014 | |
| JP | 2017524609 | A | 8/2017 | |
| WO | 9636538 | A2 | 11/1996 | |
| WO | 9742098 | A1 | 11/1997 | |
| WO | 0145941 | A2 | 6/2001 | |
| WO | 2009148037 | A1 | 12/2009 | |
| WO | 2012089813 | A1 | 7/2012 | |
| WO | 2012171676 | A1 | 12/2012 | |
| WO | 2015132770 | A1 | 9/2015 | |
| WO | 2016001662 | A1 | 1/2016 | |
| WO | 2017042332 | A1 | 3/2017 | |
| WO | WO-2017148962 | A1 * | 9/2017 | B65D 85/1045 |
| WO | 2021170730 | A1 | 9/2021 | |
| WO | 2017207458 | A1 | 12/2021 | |

OTHER PUBLICATIONS

International Search Report for corresponding application PCT/GB2021/051656 filed Jun. 30, 2021; Mail date Jan. 14, 2022.
International Search Report for corresponding application PCT/GB2021/051657 filed Jun. 30, 2021; Mail date Jan. 20, 2022.
Written Opinion for corresponding application PCT/GB2021/051655 filed Jun. 30, 2021; Mail date Jan. 14, 2022.
Written Opinion for corresponding application PCT/GB2021/051656 filed Jun. 30, 2021; Mail date Jan. 14, 2022.
Written Opinion for corresponding application PCT/GB2021/051657 filed Jun. 30, 2021; Mail date Jan. 20, 2022.
Pakistan Office Action for Application No. 485/2021, dated Jun. 5, 2024, 4 pages.
Pakistan Office Action for Application No. 486/2021, dated Jun. 5, 2024, 5 pages.
Pakistan Office Action for Application No. 484/2021, dated Jun. 5, 2024, 5 pages.

* cited by examiner

PACKAGE

TECHNICAL FIELD OF THE INVENTION

The present invention relates to a package for an aerosol provision system component or article, and a method of manufacturing a package for an aerosol provision system component or article.

BACKGROUND OF THE INVENTION

It is known to wrap a collation of delivery systems for a tobacco industry product such as an aerosol provision system component or article in a sheet material to form an inner pack placed inside a package. The inner pack is designed to save costs by reducing the amount of material required. Therefore, when the sheet material is folded about the collation to form an inner pack, side panels of the inner pack overlap by approximately 5 mm.

It is also known to seal the package with an outer film layer, typically formed from plastic, to keep the delivery systems contained inside the package fresh.

SUMMARY OF THE INVENTION

In one aspect of the present invention, there is provided a package for an aerosol provision system component or article, the package comprising: a container with an access; and an inner pack located within the container such that the inner pack can be accessed via the access; the inner pack comprising a sheet material that is arranged to form the inner pack; wherein the inner pack comprises a first end wall proximate to the access and a second end wall distal to the access longitudinally distant from the first end wall, the first end wall comprising first and second end flaps of the sheet material which extend from opposing sides of the first end wall, and wherein the first and second end flaps of sheet material are secured in position by an adhesive configured to seal the inner pack.

In some embodiments, the first flap may be larger than the second flap such that the first flap is configured to extend substantially over the first end wall of the pack towards the opposing side of the first end wall such that the first flap overlaps substantially all of the second flap. The first flap may overlap the second flap by more than 5 mm, optionally by between 5 mm and 25 mm, optionally by between 5 mm and 25 mm, preferably, by between 5 mm and 20 mm, and optionally, by between 7 mm and 15 mm.

In some embodiments, the distance between the first flap and the opposing side wall may be smaller than the distance between the second flap and its opposing side wall.

In some embodiments, the first flap may comprise a first part and a second part, the first part being secured to the second flap and the second part being unsecured to the second flap, the first part being configured to be pulled by a user to at least partially separate the portion of the sheet material from the remainder of the sheet material to allow access to the inside of the inner pack.

In some embodiments, the first flap may comprise a fold line defining one end of the first flap, and the first part of the first flap is located between the fold line and the second part of the first flap such that the second part forms a free end of the first flap.

In some embodiments, the first flap may further comprise a tab which extends from the free end of the second part of the first flap, the tab being configured to be pulled by a user to open the inner pack.

In some embodiments, the tab may comprise indicia configured to provide information to a consumer in relation to how to unseal the inner pack to gain access to the inner pack.

In some embodiments, an end of the second flap of the inner pack may comprise a cut-out which corresponds to the tab located on the free end of the first flap.

In some embodiments, the first part of the first flap may be sealed to the second flap by a resealable adhesive.

In some embodiments, the inner pack may comprise a plurality of side walls extending between the first end wall and the second end wall.

In some embodiments, the inner pack may comprise opposing first and second side walls, and opposing third and fourth side walls, wherein the fourth side wall comprises an outer flap extending from a longitudinal edge of the first side wall and an inner flap extending from a longitudinal edge of the second side wall, the outer flap and inner flap being adhered together to form the fourth side wall.

In some embodiments, the first end wall of the inner pack comprises a third flap extending from the proximal end of the third side wall and a fourth flap extending from the proximal end of the fourth side wall, the fourth flap comprising an outer flap extending from the proximal end of the outer flap of the fourth side wall and an inner flap extending from the proximal end of the inner flap of the fourth side wall, the outer flap and inner flap of the fourth flap of the first end wall being are adhered together.

In some embodiments, the inner pack further may comprise folding portions that connect the first flap of the first end wall to the third and fourth flaps of the first end wall, and folding portions that connect the second flap of the first end wall to the third and fourth flaps of the first end wall.

In some embodiments, the second end wall of the inner pack may comprise a third flap extending from the distal end of the third side wall and a fourth flap extending from the distal end of the fourth side wall, the fourth flap comprising an outer flap extending from the distal end of the outer flap of the fourth side wall and an inner flap extending from the distal end of the inner flap of the fourth side wall, the outer flap and inner flap of the fourth flap of the second end wall being adhered together.

In some embodiments, the second end wall may comprise a first flap extending from the distal end of the first side wall and a second flap extending from a distal end of the second side wall, the first flap and second flap of the second end wall being adhered together.

In some embodiments, the inner pack may further comprise folding portions that connect the first flap of the second end wall to the third and fourth flaps of the second end wall, and folding portions that connect the second flap of the second end wall to the third and fourth flaps of the second end wall.

In some embodiments, the third side wall may comprise an outer flap extending from a longitudinal edge of the first side wall and an inner flap extending from a longitudinal edge of the second side wall, the outer flap and inner flap being adhered together to form the third side wall.

In some embodiments, the third flap may comprise an outer flap extending from the proximal end of the outer flap of the third side wall and an inner flap extending from the proximal end of the inner flap of the third side wall, the outer flap and inner flap of the third flap of the first end wall being are adhered together.

In some embodiments, wherein the second end wall may comprise first and second tabs extending from side edges of the second end wall and folding portions which connect the first and second tab of the second end wall to the third and fourth side walls.

In some embodiments, the inner pack may be formed from a blank of sheet material comprising an adhesive to secure the flaps together, the adhesive comprising a first area of adhesive located on the outer flaps of the blank and a second area of adhesive located on the inner flaps of the blank.

In some embodiments, the first area of adhesive may be located on the inner surface of the outer flaps and the second area of adhesive is located on the outer surface of the inner flaps, the first and second areas of adhesive being positioned such that when the inner pack is in an assembled state the first and second areas of adhesive contact each other.

In some embodiments, the first area of adhesive may form a continuous area of adhesive over the inner surface of the first flap and outer flaps of the third and fourth flaps of the first end wall, and the outer flaps of the third and fourth side walls, and the second area of adhesive may form a continuous area of adhesive over the outer surface of the second flap of the first end wall, the inner flaps of the third and fourth flaps of the first end wall, and the inner flaps of the third and fourth side walls, and the first and second tabs of the second end wall.

In some embodiments, the first area of adhesive may be located on the inner surface of the folding portions of the first and second end walls, and the outer flap of the fourth side wall, and the second area of adhesive is located on the outer surface of the inner flap of the fourth side wall and the third flaps and the folding portions of the first and second end walls.

In some embodiments, the adhesive may be cold seal adhesive.

In some embodiments, the second area of adhesive may be located on the outer surface of the inner flaps of the third and fourth flaps of the second end wall, the inner flaps of the third and fourth side walls, and the second flap of the first end wall.

In some embodiments, the first area of adhesive may be located on folding portions of the first flap of the first end wall and folding portions of the outer flaps of the third and fourth side walls.

In some embodiments, the first area of adhesive is located on the inner surface of the first flaps of the first and second end walls, the outer flap of the fourth side wall, the outer flaps of the fourth flap of the first and second end walls, and the third flaps of the first and second end walls.

In some embodiments, the adhesive may be a heat seal adhesive.

In some embodiments, the inner pack may be hermetically sealed. In some embodiments, the container may comprise a flip lid. In some embodiments, the sheet material may have a basis weight of less than or equal to 75 grams per square metre.

In some embodiments, the sheet material of the inner pack may comprise at least 90% of a first material.

In some embodiments, the sheet material of the inner pack may comprise a first material which has a water vapour permeability of less than 6 grams per metre squared per 24 hours.

In another aspect of the present invention, there is provided an inner pack for a package for an aerosol provision system component or article, the inner pack comprising: a sheet material that is arranged to form the inner pack; and a first end wall and a second end wall longitudinally distant from the first end wall, the first end wall comprising first and second end flaps of sheet material which extend from opposing sides of the first end wall, and wherein the first and second end flaps of sheet material are secured in position by an adhesive configured to seal the inner pack.

In another aspect of the present invention, there is provided a method of manufacturing a package for an aerosol provision system component or article. The method comprises providing a sheet material, arranging the sheet material to form an inner pack having first and second walls, wherein the first wall comprises first and second end flaps of the sheet material that are secured in position by an adhesive, and locating the inner pack within a container having an access and the second wall is distal to the access.

BRIEF DESCRIPTION OF THE DRAWINGS

Embodiments of the invention will now be described, by way of example only, with reference to the accompanying drawings, in which.

DETAILED DESCRIPTION

Figure 1:
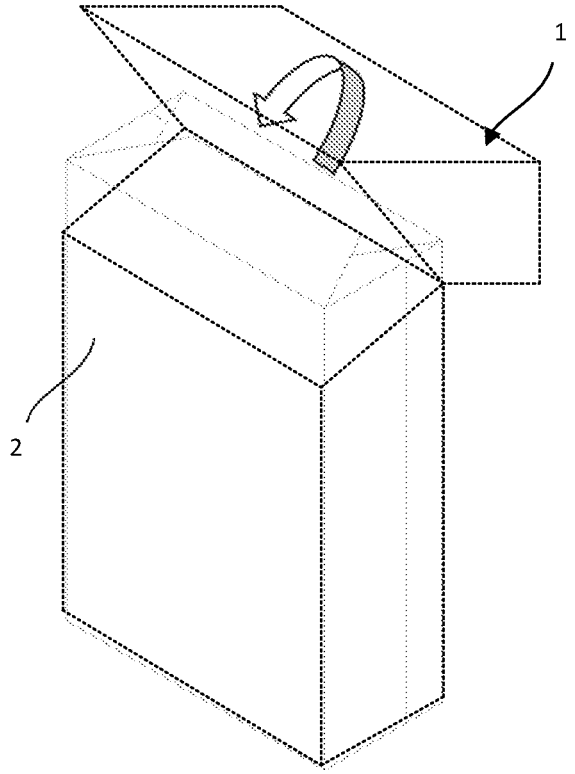
FIG. 1 shows a schematic perspective view of a known inner pack for a package.

As used herein, the term "delivery system" is intended to encompass systems that deliver at least one substance to a user and includes:

- combustible aerosol provision systems, such as cigarettes, cigarillos, cigars, and tobacco for pipes or for roll-your-own or for make-your-own cigarettes (whether based on tobacco, tobacco derivatives, expanded tobacco, reconstituted tobacco, tobacco substitutes, or other smokeable material);
- non-combustible aerosol provision systems that release compounds from an aerosol-generating material without combusting the aerosol-generating material, such as electronic cigarettes, tobacco heating products, and hybrid systems to generate aerosol using a combination of aerosol-generating materials; and
- aerosol-free delivery systems that deliver the at least one substance to a user orally, nasally, transdermally, or in another way without forming an aerosol, including but not limited to, lozenges, gums, patches, articles, comprising inhalable powders, and oral products such as oral tobacco which includes snus or moist snuff, wherein the at least one substance may or may not comprise nicotine.

According to the present disclosure, a "combustible" aerosol provision system is one where a constituent aerosol-generating material of the aerosol provision system (or component thereof) is combusted or burned during use in order to facilitate delivery of at least one substance to a user.

In some embodiments, the delivery system is a combustible provision system, such as a system selected from the group of a cigarette, a cigarillo, and a cigar.

In some embodiments, the disclosure relates to a component for use in a combustible aerosol provision system, such as, a filter, a filter rod, a filter segment, a tobacco rod, a spill, an aerosol-modifying agent release component such as a capsule, a thread, or a bead, or a paper, such as a plug wrap, a tipping paper, or a cigarette paper.

According to the present disclosure, a "non-combustible" aerosol provision system is one where a constituent aerosol-generating material of the aerosol provision system (or component thereof) is not combusted or burned in order to facilitate delivery of at least one substance to a user.

In some embodiments, the delivery system is a non-combustible aerosol provision system, such as a powered non-combustible aerosol provision system.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is an aerosol-generating material heating system, also known as a heat-not-burn system. An example of such a system is a tobacco heating system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid, or gel, and may or may not contain nicotine. In some embodiments, the hybrid system comprises a liquid or gel aerosol-generating material and a solid aerosol-generating material. The solid aerosol-generating material may comprise, for example, tobacco or a non-tobacco product.

Typically, the non-combustible aerosol provision system may comprise a non-combustible aerosol provision device and a consumable for use with the non-combustible aerosol provision device.

In some embodiments, the disclosure relates to consumables comprising aerosol-generating material and configured to be used with non-combustible aerosol provision devices. These consumables are sometimes referred to as articles throughout the disclosure.

In some embodiments, the consumable for use with the non-combustible aerosol provision device may comprise aerosol-generating material, an aerosol-generating material storage area, an aerosol-generating material transfer component, and an aerosol generator, an aerosol generation area, a housing, a wrapper, a filter, a mouthpiece, and/or an aerosol modifying agent.

Referring to FIG. 1, a known inner pack 2 for a package 1 for tobacco industry products is shown. The inner pack 2 comprises a sheet material wrapped around a bundle of tobacco industry products (not shown). The inner pack 2 comprises flaps which are folded around the bundle of tobacco industry products. However, the inner pack 2 is not sealed and so gaps can exist between the flaps which allows air to flow in and out of the inner pack which can affect the freshness of the tobacco industry products.

Figure 2:
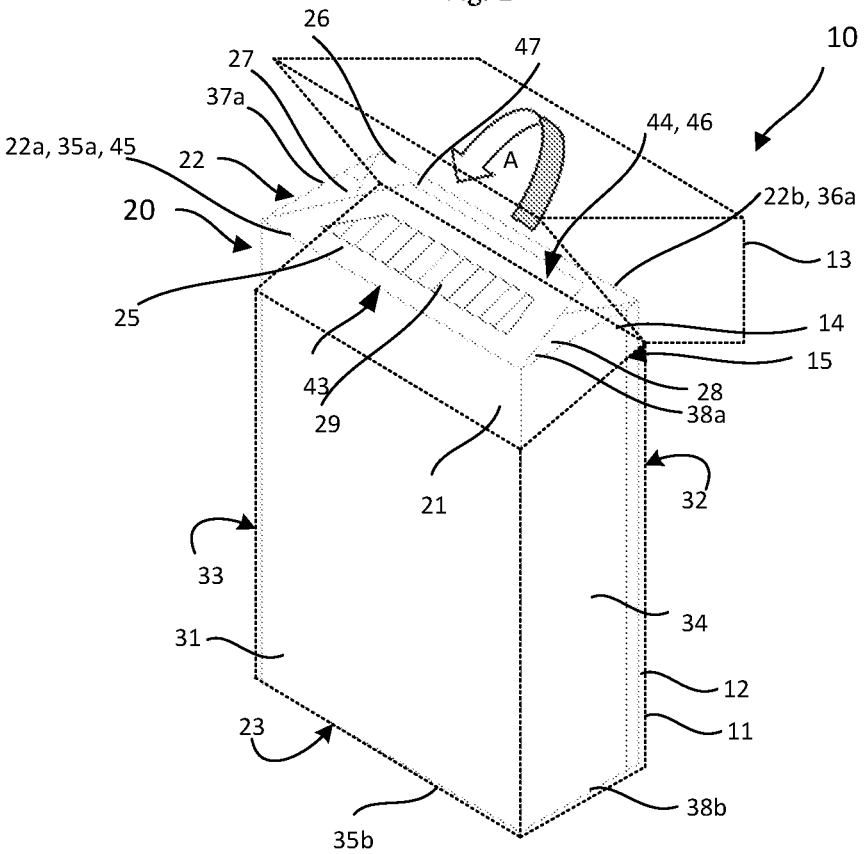
FIG. 2 shows a schematic perspective view of an inner pack of a package in its closed position.

Referring to FIG. 2, a package 10 for an aerosol provision system component or article (not shown) is illustrated. The package 10 comprises a container 11, shown in dotted lines. In the present embodiment, the container 11 is a hinge-lid type container, although it will be appreciated that other forms of container 11 may form a part of the package 10. In the illustrated embodiment, the container 11 comprises a body 12 and a lid 13 connected along a hinge line 14. The container 11 comprises an access 15. The access 15 is provided by rotating the lid 13 about the hinge line 14 relative to the body 12 of the container 11. The hinge-lid type container is also known as a flip-lid type container. That is, the lid can be flipped open by rotating the lid 13 about the hinge line 14.

The package further comprises an inner pack 20. The inner pack 20 is located within the container 11 such that the inner pack 20 can be accessed via the access 15. That is, upon rotation of the lid 13 from a closed position into an open position, shown in FIG. 2, the access 15 is provided and a user can access the inner pack 20. The inner pack 20 comprises a sheet material 21 that is arranged to form the inner pack 20.

The inner pack 20 comprises a first end wall 22. The first end wall 22 is proximate to the access 15. The inner pack further comprises a second end wall 23. The second end wall 23 is distal to the access 15. The second end wall 23 is longitudinally distant from the first end wall 22. That is, the package 10 and/or inner pack 20 comprise a longitudinal axis along which the longest dimension of the package 10 and/or inner pack 20 extends, and the first and second end walls 22, 23 are spaced apart by a distance along this axis.

As shown in FIG. 2, the first end wall 22 comprises a first flap 25 and a second flap 26. The first and second flaps 25, 26 of the first end wall 22 extend from opposing sides of the first end wall 22. That is, the first flap 25 extends from a first side 22*a* of the first end wall 22 and the second flap 26 extends from a second, opposing side 22*b* of the first end wall 22. The first and second flaps 25, 26 are attached to each other and configured to seal the inner pack 20. The first and second flaps 25, 26 may be attached to each other using an adhesive 29. The adhesive 29 may be applied between the first and second flaps 25, 26 such that the first and second flaps 25, 26 of the first end wall 22 form a seal to prevent, or at least reduce, the air permeability of the inner pack 20. The adhesive 29 may be located on the inner surface of the first flap 25 of the first end wall 22. The adhesive 29 may be located on the outer surface of the second flap 26 of the first end wall 22.

As shown in FIG. 2, the inner pack 20, similarly to each of the subsequently described inner packs, comprises a plurality of side walls which extend between the first end wall 22 and the second end wall 23. In the illustrated embodiment, as well as the subsequently described embodiments, the inner pack 20 has a cuboidal shape. Thus, the inner pack 20, and the subsequently described embodiments, comprises a first side wall 31, a second side wall 32, a third side wall 33, and a fourth side wall 34. The inner pack 20 comprises opposing first and second side walls 31, 32, and opposing third and fourth side walls 33, 34.

The inner pack 20 further comprises first, second, third, and fourth top edges 35*a*, 36*a*, 37*a*, 38*a* where the first, second, third, and fourth side walls 31, 32, 33, 34 meet the first end wall 22. Thus, the first side 22*a* of the first end wall 22 is formed by the first top edge 35*a*, and the second side 22*b* of the first end wall 22 is formed by the second top edge 36*a*. The inner pack 20 further comprises first, second, third, and fourth bottom edges 35*b*, 36*b*, 37*b*, 38*b* where the first, second, third, and fourth side walls 31, 32, 33, 34 meet the second end wall 23.

It will be appreciated that in alternative embodiments, the inner pack 20 may have a differently shaped prism, for example, but not limited to a hexagonal prism. In such an embodiment, it will be understood that the inner pack 20 would further comprise additional side walls and top and bottom edges etc.

The first end wall 22 further comprises third and fourth flaps 27, 28. The third and fourth flaps 27, 28 extend from the third and fourth top edges 37*a*, 38*a* formed by the flaps 27, 28 with the third and fourth side walls 33, 34. The third and fourth flaps 27, 28 may also comprise adhesive 29 in order to seal the first end wall 22. Thus, each flap 26, 27, 28 that the first flap 25 of the first end wall 22 overlaps may be secured to the other flaps by adhesive 29 to seal the inner pack 20.

Figure 3:
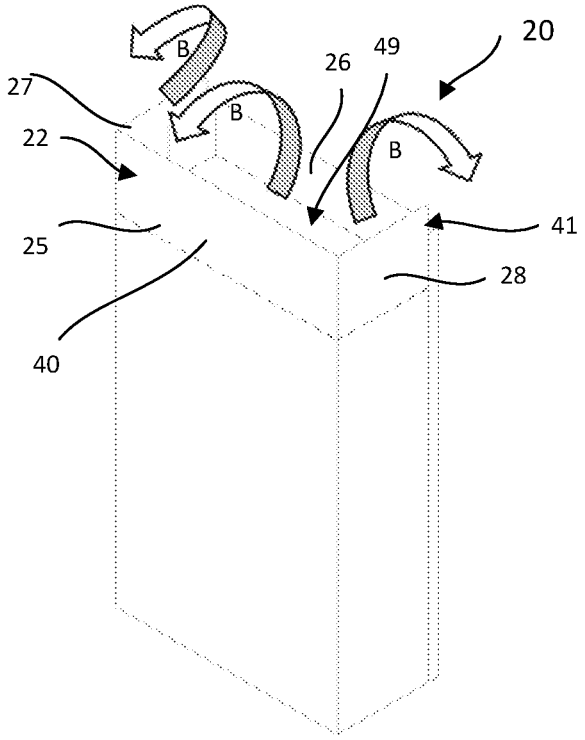
FIG. 3 shows a schematic perspective view of the inner pack of a package shown in FIG. 2 in an open position.

Furthermore, as shown in FIG. 3, the sheet material 21 of the inner pack 20 comprises a portion 40 that is at least partially separable from the remainder 41 of the sheet material 20 of the inner pack 20. The portion 40 is at least partially separable from the remainder 41 of the sheet material 21 of the inner pack 20 to unseal the inner pack 20 and allow access to the inside of the inner pack 20 so that the aerosol provision system component or article stored therein can be accessed. The portion 40 of sheet material 21 that is at least partially separable from the remainder 41 of the inner pack 20 comprises the first flap 25 of the first end wall 22.

As illustrated in FIG. 2 and FIG. 3, the first flap 25 of the first end wall 22 is larger than the second flap 26 of the first end wall 22. Referring briefly to FIG. 3, where the first and second flaps 25, 26 of the first end wall 22 are shown in an unfolded state, the first flap 25 is longer than the second flap 26, as will be explained in more detail hereinafter.

Referring back to FIG. 2, it can be seen that the first flap 25 is larger than the second flap 26 such that the first flap 25 is configured to extend substantially over the first end wall 22 of the inner pack 20 towards the opposing side 22*b* of the first end wall 22. That is, the first flap 25 extends from the first side 22*a* of the first end wall 22, i.e. the first tope edge 35*a*, substantially over the first end wall 22 towards the second, opposing side 22*b* of the first end wall 22, i.e. the second top edge 36*a*. Therefore, the first flap 25 of the first end wall 22 overlaps substantially all of the second flap 26 of the first end wall 22. The first flap may overlap the second flap by more than 5 mm, optionally by between 5 mm and 25 mm, preferably, by between 5 mm and 20 mm, and optionally, by between 7 mm and 15 mm.

Earlier reference to the first flap 25 of the first end wall 22 being longer than the second flap 26 of the first end wall 22 refers to the distance between the first flap 25 of the first end wall 22 and the opposing side wall 22*b* of the first end wall 22, i.e. the second top edge 36*a*, being smaller than the distance between the second flap 26 of the first end wall 22 and its opposing side of the first end wall 22, i.e. the first top edge 35*a* or the first side 22*a* of the first end wall 22.

The first flap 25 of the first end wall 22 comprises a first part 43 and a second part 44. The first part 43 of the first flap 25 is secured to the second flap 26 of the first end wall 22. The second part 44 of the first flap 22 is unsecured to the second flap 26 of the first end wall 22. That is, the adhesive 29 attaches the first part 43 of the first flap 25 to the second flap 26 of the first end wall 22. Therefore, the second part 44 of the first flap 25 is not secured to the second flap 26 of the first end wall 22 such that the second part 44 of the first flap 25 is free to move. The second part 44 of the first flap 25 is configured to be pulled by a user to at least partially separate the portion 40 of the sheet material 21 from the remainder 41 of the sheet material 21 of the inner pack 20 to unseal the inner pack 20 and allow access to the inside of the inner pack 20.

The first flap 25 of the first end wall 22 comprises a fold line 45. The fold line 45 defines one end of the first flap 25. The fold line 45 may be located at the first side 22*a* of the first end wall 22. That is, the fold line 45 is located at the first top edge 35*a* of the inner pack 20. The first part 43 of the first flap 25 is located between the fold line 45 and the second part 44 of the first flap 25. Therefore, the second part 44 of the first flap 25 forms a free end 46 of the first flap 25. The free end 46 of the first flap 25 comprises a free edge 47.

During opening of the inner pack 20 to gain access to the inner pack 20, a consumer places a digit under the free end 46 of the first flap 25 and grips the second part 44 of the first flap 25. The consumer then pulls on the second part 44 of the first flap 25 to break the seal provided by the adhesive 29 between the first part 43 of the first flap 25 and the second flap 26 of the first end wall 22 of the inner pack 20.

The consumer pulls on the second part 44 of the first flap 25 in the direction shown by the arrow A in FIG. 2. That is, the consumer rotates the second part 44 of the first flap about the fold line 45 of the first flap 25 of the first end wall 22. As explained above, this movement breaks the seal formed between the first and second flaps 25, 26 by the adhesive 29 and partially separates the portion 4*o*, i.e. the first flap 25 of the first end wall 22, from the remainder 41, i.e. the second flap 26 of the first end wall 22, of the inner pack 20 to allow access to the inside of the inner pack 20.

Once the seal formed by the adhesive 29 between the first and second flaps 25, 26, has been broken, the first, second, third, and fourth flaps 25, 26, 27, 28 can all be unfolded, as shown by the arrows B in FIG. 3, to provide an access 49 to the inside of the inner pack 20.

In the present embodiment, the inner pack 20 may be resealed by folding down the flaps 25, 26, 27, 28 and applying pressure to the adhesive 29 such that the first and second flaps 25, 26 reseal. Therefore, the adhesive 29 is preferably a cold seal adhesive, and more preferably a resealable cold seal adhesive. The resealable cold adhesive may be, for example, but not limited to, an adhesive derived from natural rubber, latex, resin, PVA, or Loctite Liofol CS 22-861US1. The cold seal adhesive may be chosen to match the required properties. The cold seal adhesive may be extrudable, water based, or solvent based with pealability, reclosability, or permanent seal. Cold seal adhesives are generally easy to process with high printing speeds, have long shelf life on reels of sheet material, are recyclable once applied to sheet material, and are approved for direct food contact. A cold seal adhesive is placed on both adhering surfaces and only requires contact and/or pressure to adhere together to form a seal. That is, a cold seal adhesive does not require heat to activate the adhesive.

Figure 9:
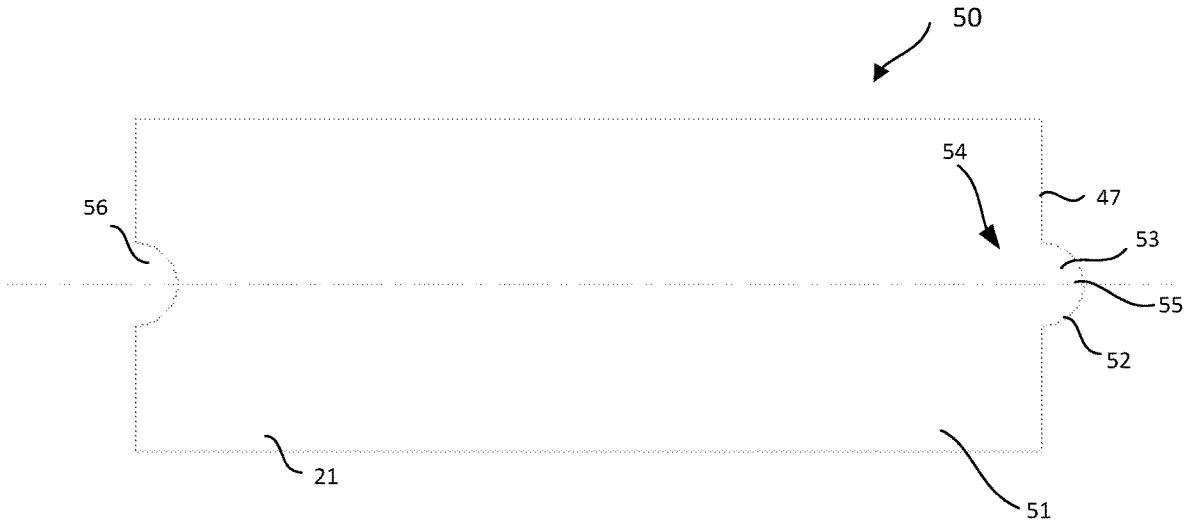
FIG. 9 shows a schematic top view of a blank for an inner pack of a package.
Figure 10:
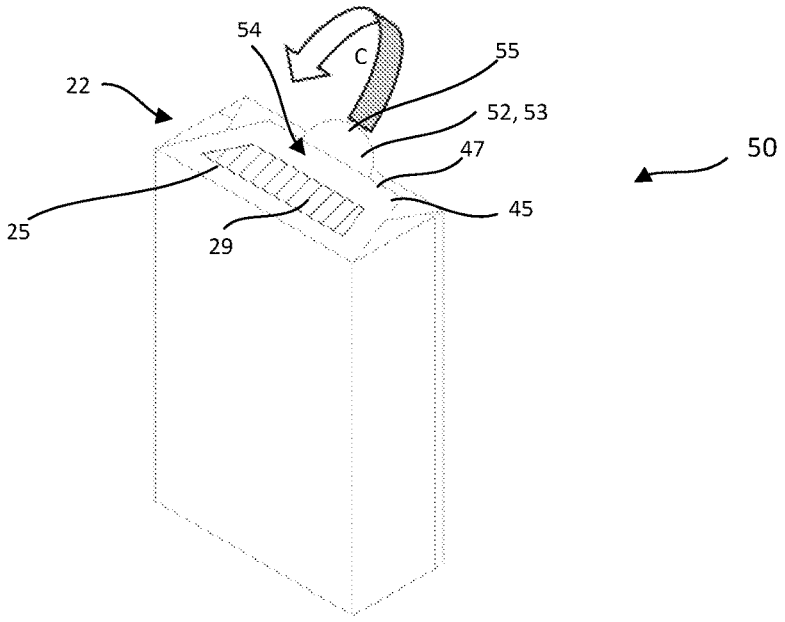
FIG. 10 shows a schematic perspective view of an inner pack of a package formed from the blank shown in FIG. 9 in a closed position.

Referring now briefly to FIG. 9 and FIG. 10, another embodiment of an inner pack 50 according to the present invention is shown. The inner pack 50 shown in FIGS. 9 and 10 is generally the same as the embodiment of the inner pack 20 described above so a detailed description will be omitted herein. Furthermore, features and components of the inner pack 50 that are the same as features and components of the inner pack 20 will retain the same terminology and reference numerals.

In FIG. 9, a blank 51 used to form the inner pack 50 is shown. FIG. 10 shows the blank 51 assembled to form the inner pack 50. In the present embodiment of the inner pack 50, the first flap 25 of the first end wall 22 further comprises a tab 52. The tab 52 extends from the free edge 47 of the second part 45 of the first flap 25. The tab 52 is configured to be pulled by a user to unseal the inner pack 50 in a similar way to the embodiment of the inner pack 20 described above.

In embodiments in which the first flap 25 of the first end wall 22 comprises the tab 52, the adhesive 29 which forms a seal between the first and second flaps 25, 26 of the first end wall 22 may be located either on both the first and second parts 43, 44 of the first flap 25, or only on the first part 43 of the first flap 25. However, in the present embodiment, the adhesive 29 is only illustrated as forming a seal between the first part 43 of the first flap 25 and the second flap 26 of the first end wall 22.

The tab 52 is a more obvious extension of the first flap 25 of the first end wall 22 which makes it more easily recognisable by a consumer and aiding the openability of the inner pack 50. Furthermore, the tab 52 may comprise at least one indicium 53. The at least one indicium 53 may be configured to provide information to a consumer in relation to how to unseal the inner pack 50 to gain access to the inside of the inner pack 50. The at least one indicium 53 may be in the form of, for example, but not limited to, printed or embossed instructions such as text, logos, arrows, or colour to identify the tab 52 or in which way it should be moved.

The tab 52 may extend from a central portion 54 of the free end 46 of the first flap 25, as illustrated in FIGS. 9 and 10. However, it will be appreciated that the tab 52 may be off-centre with respect to the free edge 47 of the first flap 25 in alternative embodiments. Furthermore, in the present embodiment, the tab 52 has a semi-circular shape. However, in an alternative embodiment, the tab 52 may have, for example, but not limited to, a square, triangular, or rectangular, etc. shape.

In some embodiments, the tab 52 may extend from the free edge 47 of the first flap 25 of the first end wall 22 beyond the second side 22*b* or second top edge 36*a* of the first end wall 22. Therefore, a section 55 of the tab 52 may project from the second side 22*b* of the first end wall 22. Thus, when the inner pack 50 is located inside a container 11, the section 55 of the tab 52 may extend into the lid 13 when the lid 13 is in its open position. The projecting section 55 of the tab 52 makes it easier to grip the first flap 25 of the first end wall 22 and easier to unseal the inner pack 50 to allow access to the inside of the inner pack 50.

The inner pack 50 may further comprise a cut-out section 56. The cut-out section 56 is formed in the second flap 26 of the first end wall 22. The cut-out section 56 is overlapped by the first flap 22 of the first end wall 22 when the inner pack 50 is sealed. Referring to the blank 51 of sheet material 21 in FIG. 9, the cut-out section 56 can be seen in the second flap 26 of the first end wall 22. The cut-out section 56 corresponds to the tab 52 located on the free end 46 of the first flap 25 of the first end wall 22. That is, the position, shape, and size of the cut-out section 56 in the second flap 26 is the same as the position, shape, and size of the tab 52 on the first flap 25. Therefore, the blank 51 of sheet material 21 from which the inner pack 51 is formed by tessellation from a web of sheet material 21. Thus, there is no material wastage in the creation of the inner pack 50.

The present embodiment of the inner pack 50 is opened in a similar fashion to the inner pack 20 described above, thus a detailed description will be omitted herein. Briefly, a consumer viewing the inner pack 50 may notice the at least one indicium 53 on the tab 52 which conveys information to the consumer that the inner pack 50 is opened by pulling on the tab 52 of the inner pack 50 and moving the tab 52 in the direction of the arrow C shown in FIG. 10. The seal formed by the adhesive 29 holding the first and second flaps 25, 26 of the first end wall 22 is broken by rotating the first flap 25 away from the second flap 26 and then each of the end wall flaps 25, 26, 27, 28 can be folded open to provide an access (not shown in FIG. 10) to the inside of the inner pack 50.

Figure 4:
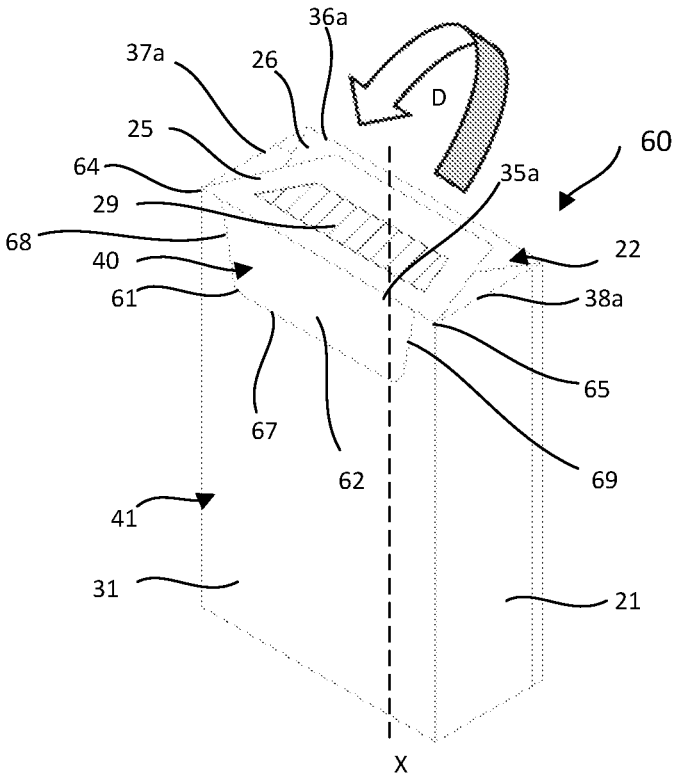
FIG. 4 shows a schematic perspective view of an inner pack of a package in a closed position.
Figure 5:
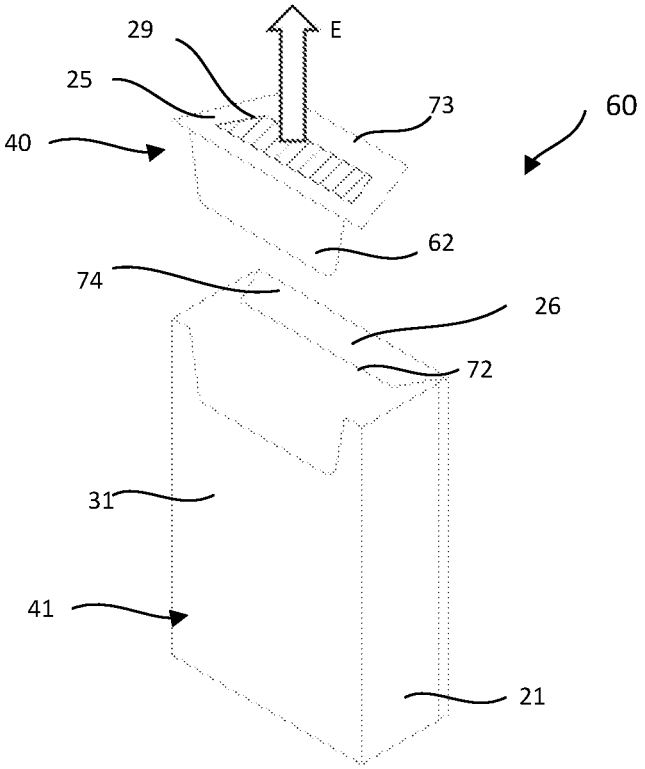
FIG. 5 shows a schematic perspective view of the inner pack of a package shown in FIG. 4 once opened.

Referring now to FIG. 4 and FIG. 5, another embodiment of an inner pack 60 according to the present invention is shown. The inner pack 60 shown in FIGS. 4 and 5 is generally the same as the embodiments of the inner pack 20, 50 described above so a detailed description will be omitted herein. Furthermore, features and components of the inner pack 60 that are the same as features and components of the inner packs 20, 50 will retain the same terminology and reference numerals.

Referring to FIG. 4, the inner pack 60 of the package 10 further comprises a first line of weakening 61. The first line of weakening 61 is configured to aid separation of the portion 40 of the sheet material 21 from the remainder 41 of the sheet material 21 of the inner pack 60 to allow access to the inner pack 60. That is, the first line of weakening 61 separates the portion 40 comprising the first flap 25 of the first end wall 22 from the remainder 41 of the inner pack 60.

Therefore, in the present embodiment, when a consumer pulls on the first flap 25 of the first end wall 22, the portion 40 comprising the first flap 25 is detached from the remainder 41 of the inner pack 60 to permanently break the seal of the inner pack 60. In embodiments comprising a first line of weakening 61, the adhesive 29 which forms the seal between the first and second flaps 25, 26 of the first end wall 22 may be a permanent adhesive, such as, for example, but not limited to, a natural rubber based adhesive, a latex based adhesive, a resin based adhesive, a cellulose based adhesive, a polypropylene ("PP") based adhesive, a polyethylene ("PE") based adhesive, a polyethylene terephthalate ("PET") based adhesive, and a polyvinyl alcohol ("PVA").

In the embodiment shown in FIG. 4, the first line of weakening 61 extends at least partially around at least one of the plurality of side walls 31, 32, 33, 34 to define the portion 40 that is separable from the remainder 41 of the sheet material 21 of the inner pack 60.

In the present embodiment, the first line of weakening 61 extends at least partially across the first side wall 31 of the inner pack 60. Therefore, the first line of weakening 61 is configured such that the portion 40 that is separable from the remainder of the sheet material 21 comprises the first flap 25 of the first end wall 22 and a section 62 of the first side wall 31.

Furthermore, in the present embodiment, the first line of weakening 61 extends partially along the first edge 35*a* from an extremity of the first flap 25 between the first end wall 22 and the first side wall 31. The first flap 22 of the inner pack 60 comprises extremities where the first edge 35*a* meets the third edge 37*a* and fourth edge 38*a* at first and second corners 64, 65, respectively. Thus, the first line of weakening 61 may extend from an extremity in the form of a first corner 64 along the first edge 35*a* towards the second corner 65 of the inner pack 60. In addition, the first line of weakening 61 may also extend from an extremity in the form of a second corner 65 along the first edge 35*a*. In some embodiments, the first line of weakening 61 may be configured to separate the first flap 25 from the third and fourth flaps 27, 28.

Between the extremities 64, 65 of the first edge 35*a* of the inner pack 60, the first line of weakening extends into the first side wall 31 of the inner pack 60. As shown in FIG. 4, the first line of weakening 61 extending through the first side wall 31 is substantially 'U-shaped'. That is, the section of the first line of weakening 61 that extends through the first side wall 31 comprises a lower portion 67, a first side portion 68, and a second side portion 69. The U-shaped line of weakening 61 is advantageous because it enables the removal of a substantial section 62 of the first side wall 31 which provides an improved ease of access to the component or article inside the inner pack 60.

In the present embodiment, the lower portion 67 of the first line of weakening 61 extends parallel to the first top edge 35*a* of the inner pack 6*o*. Furthermore, the first and second side portions 68, 69 of the first line of weakening 61 extend at an angle to the first top edge 35*a* of the inner pack 6*o*. As shown in FIG. 4, the first and second side portions 68, 69 extend outwardly towards the first and second corners 64, 65 of the first flap 25, respectively. Preferably, the first and second side portions 68, 69 of the first line of weakening 61 have a draft angle of between 10 degrees and 40 degrees with respect to a longitudinal axis X of the inner pack 60. The draft angle of the first and second side portions 68, 69 helps the portion 40 of sheet material 21 on the first side wall 31 to separate from the remainder 41 of the inner pack 60.

The inner pack 60 is opened in a similar way to the inner pack 20 described with reference to FIG. 2. A consumer pulls on the second part 44 of the first flap 25 of the first end wall 22 and rotates the first flap 25 in the direction indicated by arrow D in FIG. 4. This movement may break the seal formed by the flaps 25, 26 of the first end wall 22 and a consumer may then pull the first flap 25 upwards in the direction of the X axis, shown by arrow E in FIG. 5, to remove the portion 40 from the remainder 41 of the inner pack 60, as described in more detail hereinafter.

Referring now to FIG. 5, it can be seen that the inner pack 60 may further comprise a second line of weakening 72 which has been broken by removal of the portion 40 that is separable from the remainder 41 of the inner pack 60. The second line of weakening 72 is configured such that the portion 40 that is separable from the remainder 41 of the sheet material 21 comprises the first flap 25, the section 62 of the first side wall 31, and a portion of the second flap 26 of the first end wall 22.

In an alternative embodiment, the second line of weakening 72 may be omitted. In such an embodiment, the portion 40 of sheet material 21 that is separable from the remainder 41 of the inner pack 60 may be removed by breaking the first line of weakening 61 and the adhesive seal 29. In such an embodiment, the adhesive seal 29 may be formed from a non-permanent or releasable adhesive. Furthermore, in such an embodiment, the portion 40 that is separable from the remainder 41 of the inner pack 60 may not comprise a portion of the second flap 26 of the first end wall 22. In a further embodiment in which the adhesive seal is formed by a permanent adhesive, the portion of the second flap 26 may be torn from the remainder of the second flap 26.

In the present embodiment, the second flap 26 of the first end wall 22 comprises a first part 73, best seen in FIG. 5, and a second part 74 which are separated by the second line of weakening 72. The first part 73 of the second flap 26 is secured to the first flap 25 of the first end wall 22 by the adhesive 29. The second line of weakening 72 is configured such that the portion of the second flap 26 which forms part of the portion 40 of sheet material 21 that is separable from the remainder 41 of the inner pack 60 is the first part 73 of the second flap 26 which is attached to the first flap 25 by adhesive 29.

Referring back to FIG. 4, it can be seen that the first line of weakening 61 may extend from the first corner 64 of the first flap 25 along the third top edge 37*a* towards the second top edge 36*a* such that at least a portion of the third flap 27 of the first end wall 22 also forms a part of the portion 40 that is separable from the remainder 41 of the inner pack 60. That is, the first line of weakening 61 may extend from the first edge 35*a* alt least partially along the third edge 37*a*. Similarly, the first line of weakening 61 may extend from the second corner 65 of the first flap 25 along the fourth top edge 38*a* towards the second top edge 36*a* such that at least a portion of the fourth flap 28 of the first end wall 22 also forms a part of the portion 40 that is separable from the remainder 41 of the inner pack 60. That is, the first line of weakening 61 may extend from the first edge 35*a* at least partially along the fourth edge 38*a*.

FIG. 5 shows the remainder 41 of the inner pack 60 when a portion 40 comprising the third and fourth flaps 27, 28 of the first end wall 22 is removed from the inner pack 60. In such an embodiment, the first and second lines of weakening 61, 72 may be integrally formed. For example, the first line of weakening 61 may extend across the first end wall 22 to the ends of the second line of weakening 72, or alternatively, the second line of weakening 72 may extend across the first end wall 22 to the ends of the first line of weakening 61 on the edges of the first end wall 22 or on the side walls. The first and second lines of weakening 61, 72 may be integrally formed such that they form one continuous line of weakening. For clarity, the third and fourth flaps 27, 28 form a part of the portion 40 but have been omitted from the illustration of the portion 40 shown in FIG. 5 in order to illustrate a portion 40 which comprises solely the first flap 25 of the first end wall 22, the section 62 of the first side wall 31, and the first part 73 of the second flap 26 of the first end wall 22.

Figure 15A:
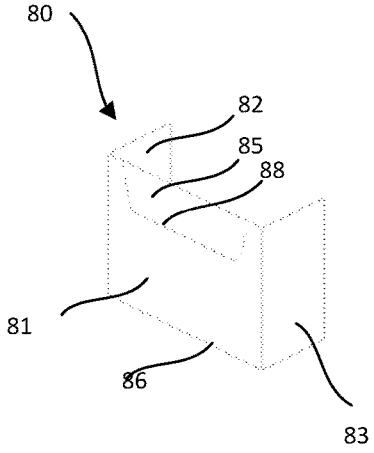
FIG. 15*a* shows a schematic perspective view of an inner frame of a package.
Figure 15B:
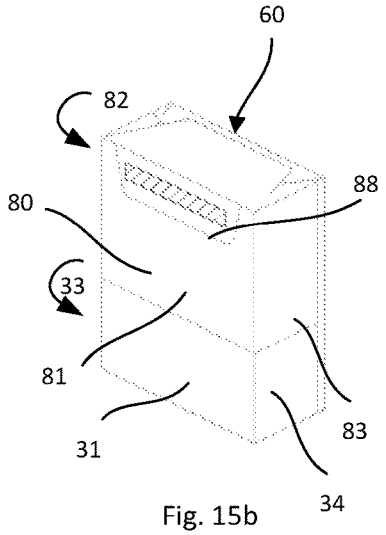
FIG. 15*b* shows a schematic perspective view of the inner frame shown in FIG. 15*a* and an inner pack of a package in a closed position.
Figure 15C:
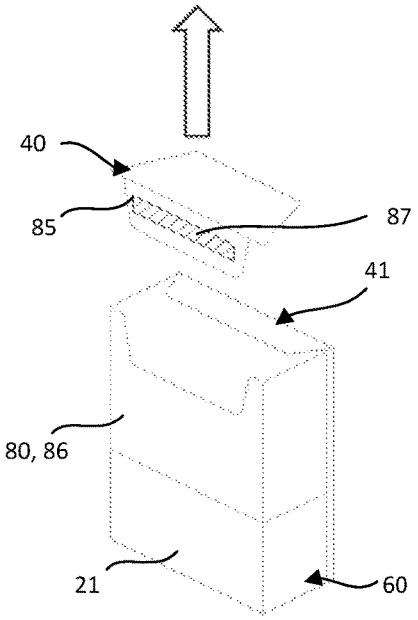
FIG. 15*c* shows a schematic perspective view of the inner frame and the inner pack of a package shown in FIG. 15*b* once opened.

Referring now to FIGS. 15*a* to 15*c*, the package 10 further comprises an inner frame 80. In one embodiment, the inner frame 80 is configured to be located at least partially around the inner pack 60. In another embodiment, the inner frame 80 is configured to be located inside the inner pack 60.

Referring to FIG. 15*a*, the inner frame 80 comprises a first side wall 81, and opposing side walls 82, 83. The first side wall 81 is configured to be located against, or at least parallel to, the first side wall 31 of the inner package 60, as shown in FIG. 15*b*. The opposing side walls 82, 83 extend from opposite sides of the first side wall 81 of the inner frame 80. The first opposing side wall 82 is configured to be located against, or at least parallel to the third side wall 33 of the inner pack 60, as shown in FIG. 15*b*. The second opposing side wall 83 is configured to be located against, or at least parallel, to the fourth side wall 34 of the inner pack 6*o*, as shown in FIG. 15*b*.

Referring to FIG. 15*c*, at least a portion 85 of the inner frame 80 is configured to be separated from the remainder 86 of the inner frame 80 when the portion 40 of the inner pack 60 is separated from the remainder 41 of the inner pack 60. The portion 85 of the inner frame 80 which is configured to be separated from the remainder 86 of the inner frame 80 is secured to the portion 40 of the inner pack 60. The portion 85 of the inner frame 80 which is separable from the remainder 86 of the inner frame 80 maybe secured to the portion 40 of the sheet material 21 which is separable from the remainder 41 of the inner pack 60 by an adhesive 87. Therefore, removal of the portion 40 of the inner pack 60 which is separable from the remainder 41 of the inner pack 60 causes the portion 85 of the inner frame 80 to be separated from the remainder 86 of the inner frame 80.

The inner frame 80 provides the advantage of improved structural support for the inner pack 60. That is, the inner frame 80 helps to maintain the structure of the access 49 to the inside of the inner pack 60 that is presented to the consumer once the portion 40 of sheet material that is separable from the remainder 41 of the inner pack 60 has been removed.

The inner frame 80 may further comprise a third line of weakening 88 which defines the portion 85 of the inner frame 80 configured to be separated from the remainder 86 of the inner frame 80. The third line of weakening 88 in the inner frame 80 may be superimposed over the first line of weakening 61 in the first side wall 31 of the inner pack 60. That is, the shape of the portion 85 of the inner frame 80 that is separable from the remainder 86 of the inner frame 80 may correspond to the shape of the portion 40 of the inner pack 60 that is separable from the remainder 41 of the inner pack 60 that the inner frame 80 overlaps. Therefore, all of the portion 85 of the inner frame 80 that is separable from the remainder 86 of the inner frame 80 may be attached to the portion 40 of the sheet material 21 that is separable from the reminder of the inner pack 60. The adhesive may be a permanent adhesive. In some embodiments, only a section of the portion 85 may be attached to the portion 40 with permanent adhesive.

Figure 6:
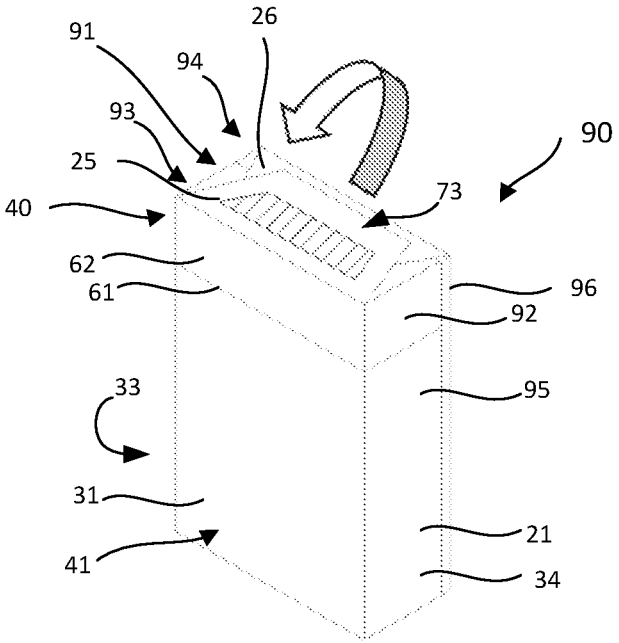
FIG. 6 shows a schematic perspective view of an inner pack of a package in a closed position.
Figure 7:
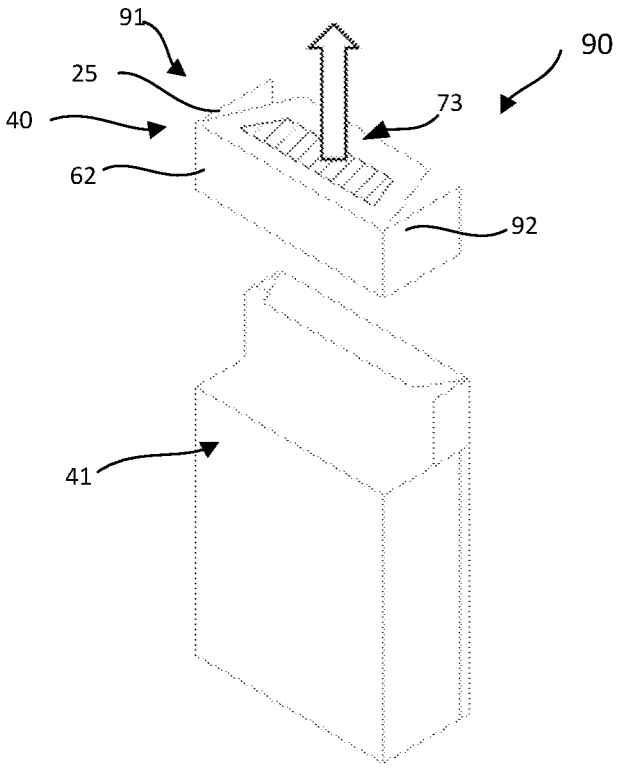
FIG. 7 shows a schematic perspective view of the inner pack of a package shown in FIG. 6 once opened.

Referring now to FIG. 6 and FIG. 7, another embodiment of an inner pack 90 according to the present invention is shown. The inner pack 90 shown in FIGS. 6 and 7 is generally the same as the embodiments of the inner pack 20, 50, 60 described above so a detailed description will be omitted herein. Furthermore, features and components of the inner pack 90 that are the same as features and components of the inner packs 20, 50, 60 will retain the same terminology and reference numerals.

Referring to FIG. 6, the first line of weakening 61 extends across the first side wall 31 of the inner pack 90 and extends at least partially across the third and fourth side walls 33, 34. Therefore, the portion 40 which is separable from the remainder 41 of the sheet material 21 comprises the first flap 25 and the first part 73 of the second flap 26 of the first end wall 22, a section 62 of the first side wall 31, at least a part 91 of the third side wall 33, and at least a part 92 of the fourth side wall 34, as illustrated in FIG. 7.

In FIG. 6, as in those previously described, the third side wall 33 comprises an outer flap 93 and an inner flap 94 which are sealed together to form a side seal. Preferably, the side seal is formed by an adhesive, as explained in more detail hereinafter. Furthermore, in FIG. 6 as in those previously described, the fourth side wall 34 comprises an outer flap 95 and an inner flap 96 which are also sealed together to form a side seal. Preferably, the side seal is formed by an adhesive, as will be explained in more detail hereinafter. In some embodiments, the first line of weakening 61 is configured to extend across the third and fourth side walls 33, 34 such that the parts 91, 92 of the third and fourth side walls 33, 34 of portion 40 which is separable from the remainder 41 of the sheet material 21 comprises the outer flap 93 of the third side wall 33 and the outer flap 95 of the fourth side wall 34.

In other embodiments, the first line of weakening 61 is configured to extend across the third and fourth side walls 33, 34 such that the parts 91, 92 of the third and fourth side walls 33, 34 of portion 40 which is separable from the remainder 41 of the sheet material 21 comprises the outer flap 93 and at least a portion of the inner flap 94 of the third side wall 33 and the outer flap 95 and at least a portion of the inner flap 96 of the fourth side wall 34.

In the present embodiment, the first line of weakening 61 extending through the first side wall 33 extends parallel to but spaced from the first edge 35*a* of the inner pack 90. Furthermore, the first line of weakening 61 extending through the third and fourth side walls 33, 34 also extends parallel to the third and fourth edges 37*a*, 38*a* of the inner pack 90. Thus, the line of weakening 61 may be generally straight. This is especially true when the line of weakening 61 is formed in a blank of sheet material 21 before the inner pack is formed. A straight line of weakening 61 is advantageous because it is simple to machine. In the present embodiment, the portion 40 of sheet material 21 that is separable from the remainder 41 of the inner pack 90 may be removed by separating the portion 40 from the remainder 41 along the line of weakening 61, and optionally the side seals between the outer and inner flaps 93, 94, 95, 96 of the third and fourth side walls 33, 34, and the top seal formed by the adhesive 29.

Figure 8:
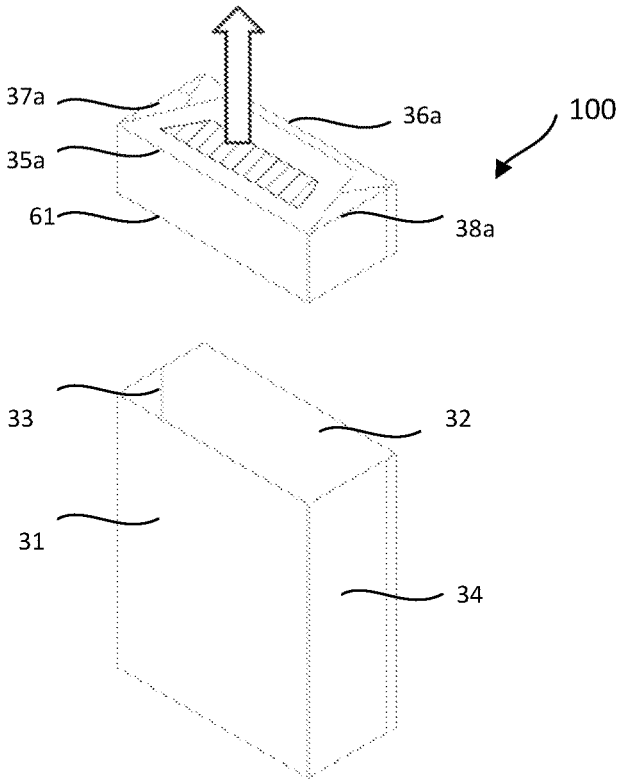
FIG. 8 shows a schematic perspective view of an inner pack of a package once opened.

Referring now to FIG. 8, another embodiment of an inner pack 100 according to the present invention is shown. The inner pack wo shown in FIG. 8 is generally the same as the embodiments of the inner pack 20, 50, 60, 90 described above so a detailed description will be omitted herein. Furthermore, features and components of the inner pack 100 that are the same as features and components of the inner packs 20, 50, 60, 90 will retain the same terminology and reference numerals.

In the present embodiment, the first line of weakening 61 extends around each of the plurality of side walls 31, 32, 33, 34. That is, the first line of weakening 61 extends through the first side wall 31, the second side wall 32, the third side wall 33, and the fourth side wall 34. Therefore, the portion 40 of sheet material 21 that is separable from the remainder 41 of the inner pack wo comprises the first end wall 22, and each of the side walls 31, 32, 33, 34. In the present embodiment, the portion 40 of sheet material 21 can be removed without separating a seal formed by an adhesive 29. Therefore, the adhesive used may be a non-releasable adhesive to ensure that the line of weakening 61 is broken rather than the seal formed by the adhesive 29. In an embodiment, the first line of weakening 61 extends parallel but spaced from the respective edges 35*a*, 36*a*, 37*a*, 38*a* when it extends through each of the side walls 31, 32, 33, 34.

Referring now to FIG. 11 to FIG. 14*b*, another embodiment of a package no according to the present invention is shown. The package no shown in FIGS. 11 to 14*b* is generally the same as the embodiments of the package 10 described above so a detailed description will be omitted herein. Furthermore, features and components of the package no that are the same as features and components of the package 10 will retain the same terminology and reference numerals.

The package no comprises a container 11 with an access 15 (illustrated in FIG. 2). The package no further comprises an inner pack 120. The inner pack 120 is configured to be located within the container 11 such that the inner pack 120 can be accessed via the access 15. The inner pack 120 comprises a sheet material 21 that is arranged to form the inner pack 120. The inner pack 120 further comprises a tear strip 121 that is configured such that, during use, the tear strip 121 can be pulled such that a portion 40 of the sheet material 21 is at least partially separable from a remainder 41 of the inner pack 120 to allow access to the inside of the inner pack 120.

Figure 11:
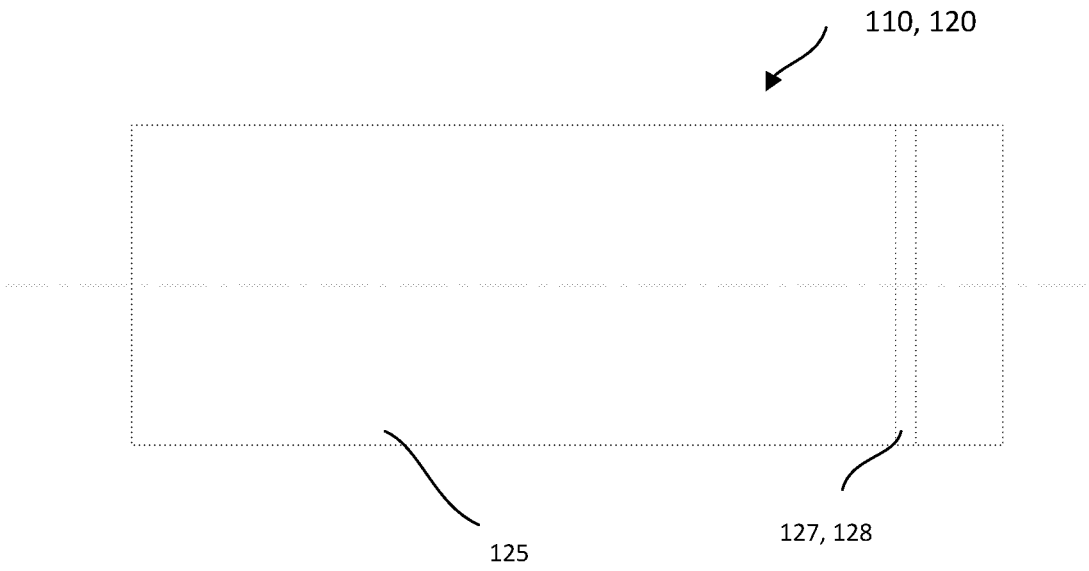
FIG. 11 shows a schematic top view of a blank for an inner pack of a package.

Referring to FIG. 11, a blank 125 for forming the inner pack 120 is illustrated. The blank 125 comprises the tear strip 121 located proximate to one end of the blank 125.

Figure 12:
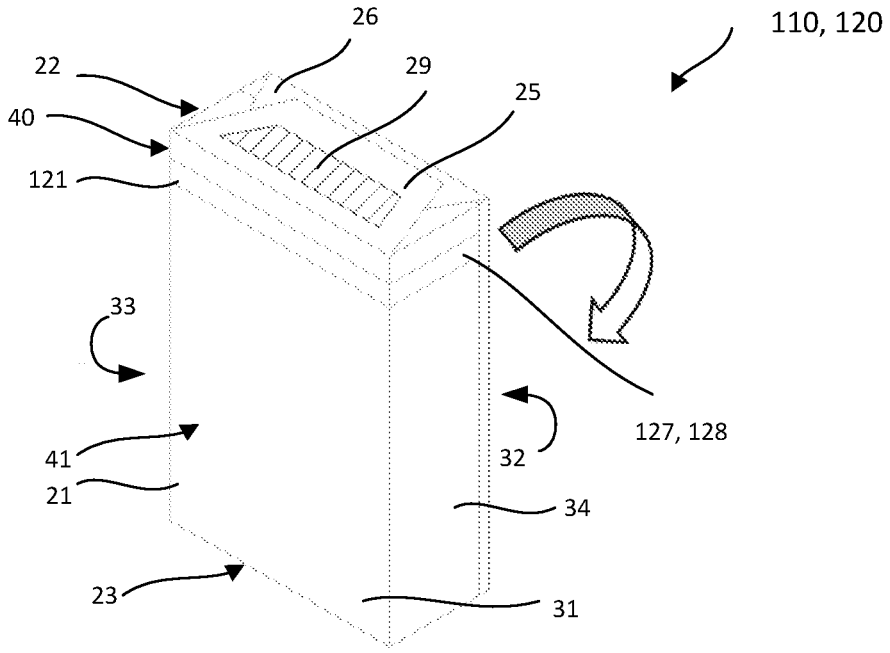
FIG. 12 shows a schematic perspective view of an inner pack of a package formed from the blank shown in FIG. 11 in a closed position.

Referring to FIG. 12, the inner pack 120 is shown in its assembled state. The inner pack 120 comprises a first end wall 22 and a second end wall 23. The first and second end walls 22, 23 are separated by a plurality of side walls 31, 32, 33, 34. The tear strip 121 extends along at least one of the plurality of side walls 31, 32, 33, 34. Preferably, the tear strip 121 extends across each of the plurality of side walls 31, 32, 33, 34 such that the portion 40 of the sheet material 21 is completely separable from the remainder 41 of the inner pack 120.

The tear strip 121 extends parallel to the top edges 35*a*, 36*a*, 37*a*, 38*a* of the inner pack 120 in each of the plurality of side walls 31, 32, 33, 34 through which the tear strip 121 extends. Furthermore, the tear strip 121 may comprise a tab 127 on one end 128 of the tear strip 121. The tab 127 is configured such that, during use, the tab 127 can be gripped by a user to pull the tear strip 121 and gain access inside the inner pack 120. The tear strip 121 may be formed by parallel lines of weakening that extend around at least one of the plurality of side walls 31, 32, 33, 34.

Similarly to the package 10 described previously, the inner pack 120 of the package 110 is sealed. That is, the first end wall 22 of the inner pack 120 comprises a first flap 25 and a second slap 26 which extend from opposing edges 35*a*, 36*a* of the first end wall 22 and are secured together. The first and second flaps 25, 26 of the first end wall 22 are secured together by adhesive 29. In the present embodiment, illustrated in FIG. 12, the tear strip 121 is located proximate to the first end wall 22. Furthermore, in the present embodiment, illustrated in FIG. 12, the first end wall 22 of the inner pack 120 is located proximate to the access 15 of the package 110.

In some embodiments, the package no may further comprises an inner frame (not shown). The inner frame may be located at least partially around the inner pack 120. However, so that the tear strip 121 is accessible to a consumer, the inner frame is spaced from the first end wall 22 which is proximate to the access 15 such that the top of the inner frame is further from the first end wall 22 than the tear strip 121.

Figure 13:
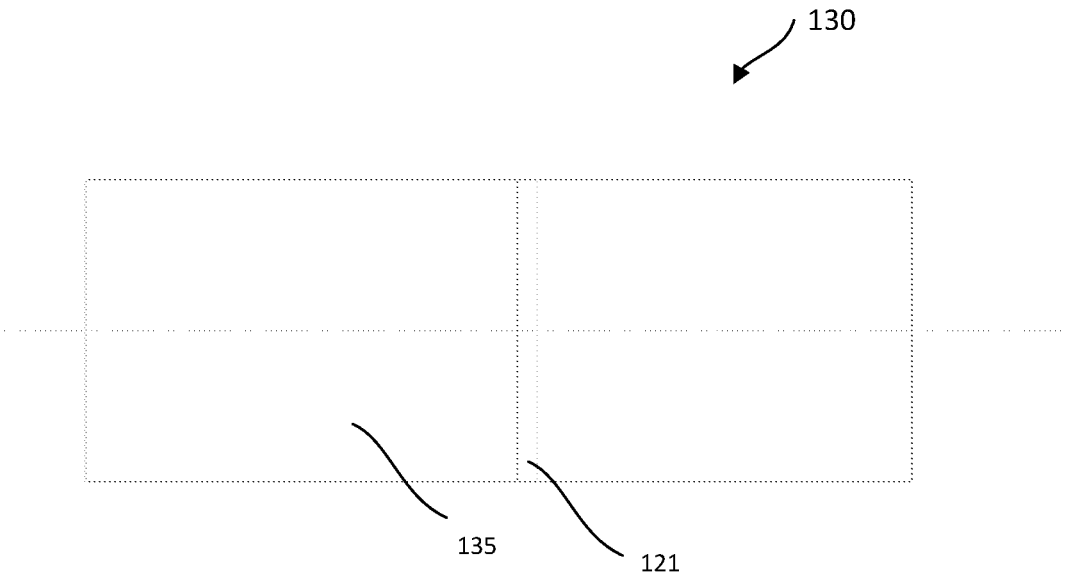
FIG. 13 shows a schematic top view of a blank for an inner pack of a package.
Figure 14A:
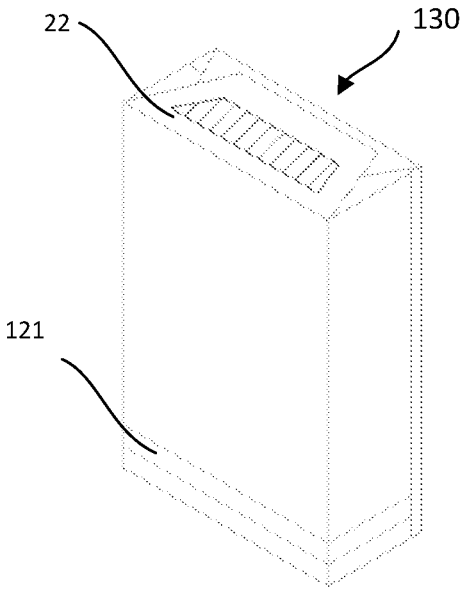
FIG. 14*a* shows a schematic perspective view of a first end of an inner pack of a package formed from the blank shown in FIG. 13 in a closed position.
Figure 14B:
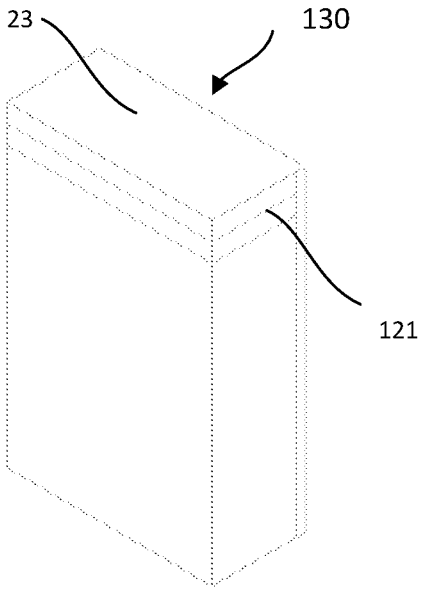
FIG. 14*b* shows a schematic perspective view of a second end of an inner pack of a package formed from the blank shown in FIG. 13 in a closed position.

Referring now to FIGS. 13 to 14*b*, an alternative embodiment of the inner pack 130 is shown. The inner pack 130 is essentially the same as the inner pack 120 described above, except for the location of the tear strip 121. FIG. 13 shows a blank 135 for forming the inner pack 130. In the present embodiment, the blank 135 comprises the tear strip 121 located centrally in the blank 135.

FIGS. 14*a* and 14*b* show the inner pack 130 in an assembled state. FIG. 14*a* shows a bottom perspective view of the inner pack 130. That is, in the present embodiment, the tear strip 121 is located proximate to the second end wall 23, i.e. closer to the second end wall 23 than the first end wall 22. Therefore, the inner pack 130 must be turned upside-down relative to the inner pack 120 shown in FIG. 12 so that the tear strip 121 is proximate to the access 15 of the package 110. Thus, in the present embodiment, illustrated in FIG. 14*a*, the second end wall 23 of the inner pack 120 is located proximate to the access 15 of the package 110. This provides the advantage that the inner pack 130 may be arranged within a package no such that when the package no is opened, the consumer is presented with an end of the inner pack without folds and/or flaps. This improves the aesthetic and/or experience for some consumers.

In some embodiments, the package no may further comprises an inner frame (not shown). The inner frame may be located at least partially around the inner pack 130. However, so that the tear strip 121 is accessible to a consumer, the inner frame is spaced from the second end wall 23 which is proximate to the access 15 such that the top of the inner frame is further from the second end wall 23 than the tear strip 121.

Figure 22:
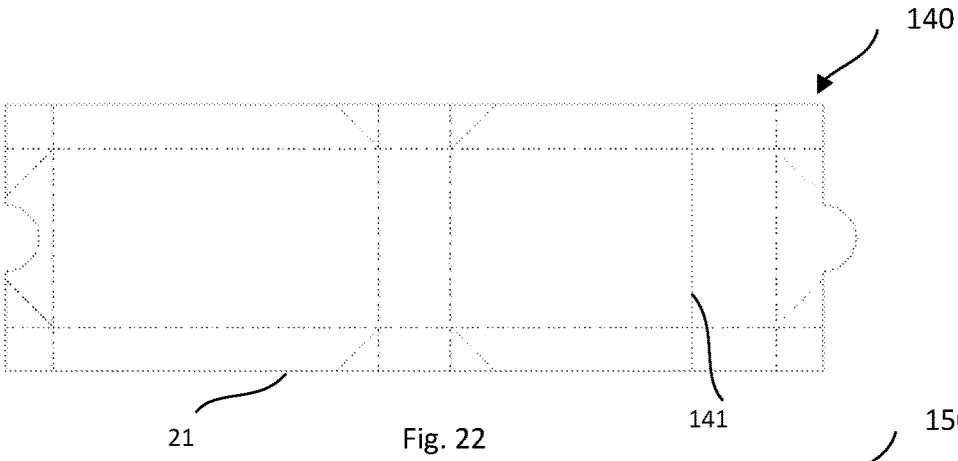
FIG. 22 shows a schematic top view of a blank for forming an inner pack of a package comprising a line of weakness.

In some embodiments, the lines of weakening 61, 72 may extend partially through the sheet material 21 of the inner pack 60, 90, 120, 130. Referring to FIG. 22, an inner wrap 140 for an aerosol provision system or article can be manufactured by providing a sheet material 21 for being arranged into an inner pack, and providing one or more deformations 141 partially through the thickness of the sheet material such that, once the sheet material is arranged into an inner pack, the sheet material can be torn along the one or more deformations such that a portion of the sheet material is at least partially separated from a remainder of the sheet material to allow access to the inside of the inner pack.

The inner wrap 140 for forming an inner pack for an aerosol provision system component or article comprises a sheet material for being arrange into an inner pack and comprising one or more deformations 141 partially through the thickness of the sheet material such that, when the inner wrap is arranged into an inner pack, the sheet material can be torn along the one or more deformations such that a portion of the sheet material is at least partially separated from a remainder of the sheet material to allow access to the inside of the inner pack.

Figure 23:
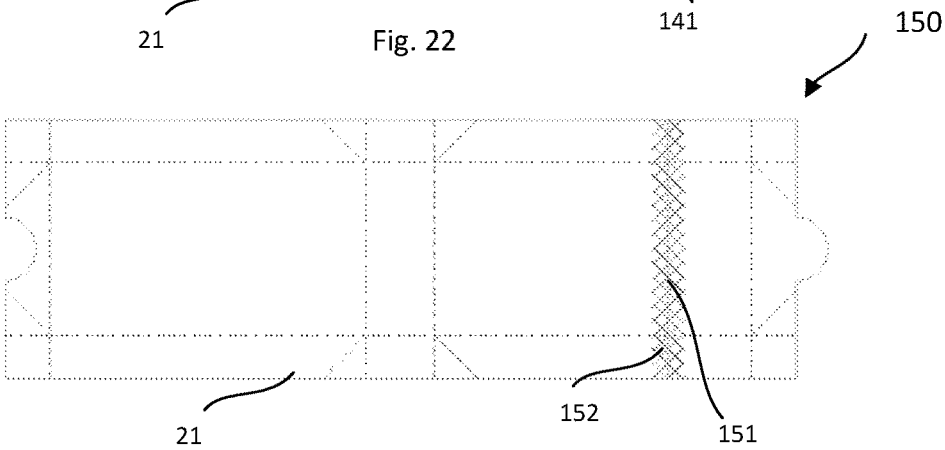
FIG. 23 shows a schematic top view of a blank for forming an inner pack of a package comprising a line of weakness and a glue pattern.

In other embodiments, the lines of weakening 61, 72 may extend through the sheet material 21 of the inner pack 60, 90, 120, 130. Referring to FIG. 23, an inner wrap 150 for an aerosol provision system or article can be manufactured by providing a sheet material 21 for being arranged into an inner pack, providing one or more cuts 151 through the thickness of the sheet material such that, when the sheet material is arranged into an inner pack, the sheet material can be torn along the one or more cuts such that, a portion of the sheet material is at least partially separated from a remainder of the sheet material to allow access to the inside of the inner pack, and sealing the one or more cuts using a sealing material 152.

Therefore, the inner pack 60, 90, 120, 130 may further comprise a layer of adhesive 152 located on the inner side of the inner pack 60, 90, 120, 130 to cover the line of weakening 61, 72. The layer of adhesive 152 is configured to seal the inner pack 60, 90, 120, 130 to at least reduce the air permeability of the inner pack 60, 90, 120, 130 to help preserve the freshness of the contents of the inner pack 60, 90, 120, 130. The layer of adhesive 152 may comprise a heat activated adhesive.

The inner wrap 150 for forming an inner pack for an aerosol provision system component or article comprises a sheet material 21 for being arranged into an inner pack and comprising one or more cuts 151 through the thickness of the sheet material such that, when the inner wrap is arranged into an inner pack, the sheet material can be torn along the one or more cuts such that a portion of the sheet material is at least partially separated from a remainder of the sheet material to allow access to the inside of the inner pack, and a sealing material 152 that is applied over the one or more cuts to seal the one or more cuts.

In some embodiments, the first and/or second line of weakening 61, 72 may be formed by laser scoring or by partial laser scoring. In other embodiments, the first and/or second lines of weakening 61, 72 may be formed by deformations in the sheet material 21 formed by an embossing roller. The embossing roller may deform the sheet material 21 by cutting, embossing, scoring, or partially cutting the sheet material 21 of the inner pack 60, 90, 120, 130.

In some embodiments, the sheet material 21 comprises a deadfold The sheet material 21 may have a basis weight of less than or equal to 75 grams per square meter. Furthermore, in some embodiments, the inner pack 20, 60, 90, 120, 130 is hermetically sealed.

Referring now to FIGS. 16 to 21, inner wrap configurations and gluing options for the inner pack are schematically shown.

Figure 16:
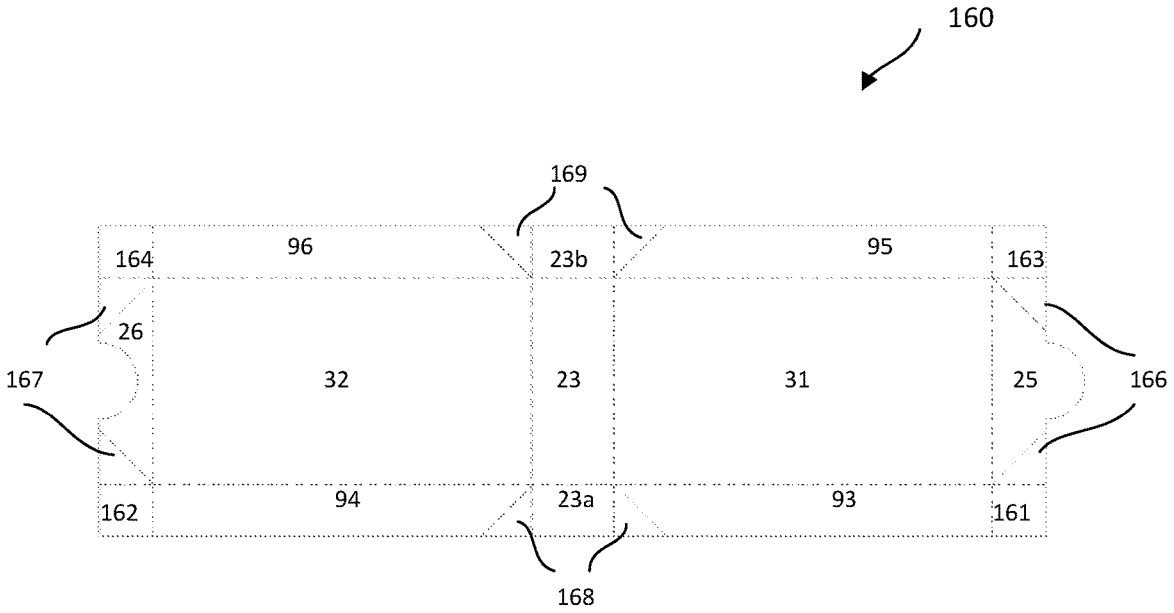
FIG. 16 shows a schematic top view of a blank for forming an inner pack of a package.

Referring to FIG. 16, a blank 160 for forming an inner pack 20, 60, 90, 120, 130 is shown. When the blank 160 is assembled into an inner pack, the inner pack comprises opposing first and second side walls 31, 32, and opposing third and fourth side walls 33, 34. The fourth side wall 34 comprises an outer flap 95, and an inner flap 96 which are adhered together to form the fourth side wall 34. The outer flap 95 of the fourth side wall 34 extends from a longitudinal edge of the first side wall 31 and the inner flap 96 of the fourth side wall 34 extends from a longitudinal edge of the second side wall 32.

Furthermore, when the blank 160 is assembled into an inner pack, the third side wall 33 of the inner pack comprises an outer flap 93 extending from a longitudinal edge of the first side wall 32 and an inner flap 94 extending from a longitudinal edge of the second side wall 32. The outer flap 93 and the inner flap 94 are adhered together to form the third side wall 33.

The first end wall 22 of the inner pack further comprises a third flap 27 extending from the proximal end of the third side wall 33. The first end wall 22 of the inner pack further comprises a fourth flap 28 extending from the proximal end of the fourth side wall 34. The fourth flap 28 comprises an outer flap 163 extending from the proximal end of the outer flap 95 of the fourth side wall 34 and an inner flap 164 extending from the proximal end of the inner flap 96 of the fourth side wall 34. The outer flap 163 and the inner flap 164 of the fourth flap 28 of the first end wall 22 are adhered together to form the fourth flap 28.

Furthermore, the third flap 27 comprises an outer flap 161 extending from the proximal end of the outer flap 93 of the third side wall 33 and an inner flap 162 extending form the proximal end of the inner flap 94 of the third side wall 33. The outer flap 161 and the inner flap 162 are adhered together to form the third flap 27 of the first end wall 22.

In addition, the inner pack of FIG. 16 comprises folding portions 166 that connect the first flap 25 of the first end wall 22 to the third and fourth flaps 27, 28 of the first end wall 22 and folding portions 167 that connect the second flap 26 of the first end wall 22 to the third and fourth flaps 27, 28 of the first end wall 22. The folding portions 166 form a part of the first flap 25 of the first end wall 22 and the folding portions 167 form a part of the second flap 26 of the first end wall 22. In the present embodiment, a folding portion 166 connects the first flap 25 to the outer flap 161 of the third flap 27 of the first end wall 22 and a folding portion 166 connects the first flap 25 to the outer flap 163 of the fourth flap 28 of the first end wall 22. Also, a folding portion 167 connects the second flap 26 to the inner flap 162 of the third flap 27 of the first end wall 22 and a folding portion 167 connects the second flap 26 to the inner flap 164 of the fourth flap 28 of the first end wall 22.

The second end wall 23 comprises first and second tabs 23*a*, 23*b* extending from side edges of the second end wall 23 and folding portions 168, 169 which connect the first and second tabs 23*a*, 23*b* of the second end wall 23 to the third and fourth side walls 33, 34. The folding portions 168 form a part of the outer and inner flaps 93, 94 of the third side wall 33. The folding portions 169 form a part of the outer and inner flaps 95, 96 of the fourth side wall 34. In the present embodiment, a folding portion 168 connects the first tab 23*a* to the outer flap 93 of the third side wall 33 and a folding portion 168 connects the first tab 23*a* to the inner flap 94 of the third side wall 33. Also, a folding portion 169 connects the second tab 23*b* to the outer flap 95 of the fourth side wall 34 and a folding portion 169 connects the second tab 23*b* to the inner flap 96 of the fourth side wall 34.

Thus, as previously discussed, the inner pack comprises a first flap 25 and a second flap 26 of the first end wall 22, a second end wall 23, a first side wall 31, a second side wall 32. The inner pack also comprises third and fourth side walls 33, 34, each formed by outer flaps 93, 95 and inner flaps 94, 96. The inner pack also comprises third and fourth end wall flaps 27, 28, each formed by outer 161, 163 and inner flaps 162, 164. The inner pack also comprises folding portions 166 of the first flap 25 of the first end wall 22 and folding portions 167 of the second flap 26 of the first end wall 22. The inner pack also comprises folding portions 168 of the outer and inner flaps 93, 94 of the third side wall 33, and folding portions 169 of the outer and inner flaps 95, 96 of the fourth side wall 34. In addition, the second end wall 23 also comprises first and second flaps 23*a*, 23*b*.

Figure 17:
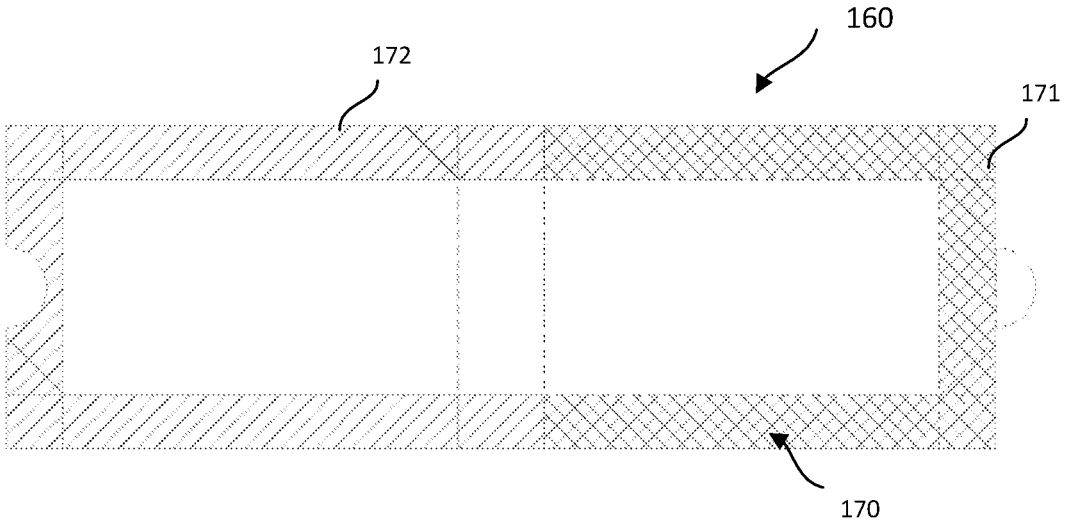
FIG. 17 shows a schematic top view of a blank for forming an inner pack of a package with a glue pattern applied.

Referring to FIG. 17, the inner package is formed from an blank 160 of sheet material 21 which comprises an adhesive 170 to secure the flaps together, The adhesive 170 comprises a first area of adhesive 171 located on the outer flaps of the blank 160 and a second area of adhesive 172 located on the inner flaps of the blank 160.

In the present embodiment, the first area of adhesive 171 is located on the inner surface of the flaps, indicated by cross-hatching in FIG. 17, and the second area of adhesive 172 is located on the outer surface of the flaps, indicated by hatching in FIG. 17. The first and second areas of adhesive 171, 172 are positioned such that when the inner pack is in an assembled state, the first and second areas of adhesive 171, 172 contact each other.

In the present embodiment, the first area of adhesive 171 forms a continuous area of adhesive over the inner surface of the first flap 25 of the first end wall 22, the outer flaps 161, 163 of the third and fourth flaps 27, 28 of the first end wall 22, and the outer flaps 93, 95 of the third and fourth side walls 33, 34. Furthermore, in the present embodiment, the second area of adhesive 172 forms a continuous area of adhesive over the outer surface of the second flap 26 of the first end wall 22, the inner flaps 162, 164 of the third and fourth flaps 27, 28 of the first end wall 22, and the inner flaps 94, 96 of the third and fourth side walls 33, 34.

In the present embodiment, the adhesive 180 is a cold seal adhesive. The cold seal adhesive may be, for example, but not limited to, an adhesive derived from natural rubber, latex, resin, PVA, or Locitie Liofol CS 22-861US1. The cold seal adhesive may be chosen to match the required properties. The cold seal adhesive may be extrudable, water based, or solvent based with pealability, reclosabilitys, or permanent seal. Cold seal adhesives are generally easy to process with high printing speeds, have long shelf life on reels of sheet material, are recyclable once applied to sheet material, and are approved for direct food contact. A cold seal adhesive is placed on both adhering surfaces and only requires contact and/or pressure to adhere together to form a seal. That is, a cold seal adhesive does not require heat to activate the adhesive.

Figure 18:
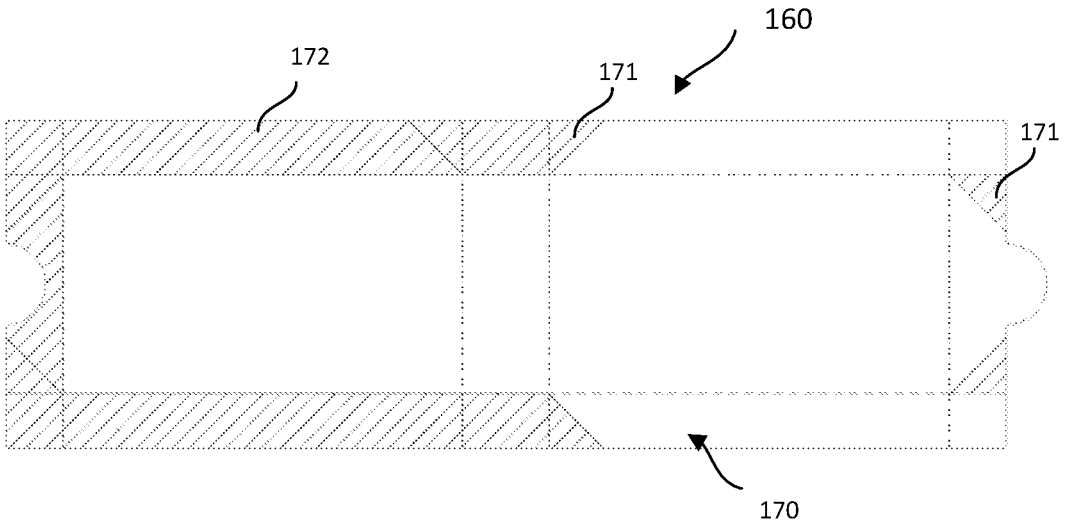
FIG. 18 shows a schematic top view of a blank for forming an inner pack of a package with a glue pattern applied.

Referring now to FIG. 18, the blank 160 is the same as shown in FIGS. 16 and 17.

However, the glue pattern is different. In the present embodiment, the inner pack comprises a second area of adhesive 172 located on the outer surface of the inner flaps 162, 164 of the third and fourth flaps 27, 28 of the first end wall 22, the inner flaps 94, 96 of the third and fourth side walls 33, 34, and the second flap 26 of the first end wall 22.

Furthermore, in the present embodiment, the first area of adhesive 171 is located on folding portions 166 of the first flap 25 of the first end wall 22, and on the folding portions 168 of the outer flaps 93, 95 of the third and fourth side walls 33, 34.

In the present embodiment, the adhesive 180 is a heat seal adhesive. The heat seal adhesive may be, for example, but not limited to, adhesives based on polypropylene (PP), polyethylene (PE), and polyethylene terephthalate (PET) plastics, Loctite Liofol HS 2809-22 RE, or cellulosic coatings. Heat seal adhesives based on PP, PE, and PET plastics have low sealing temperatures. A cellulosic coating can be used as a heat seal solution and is also recyclable. A heat seal adhesive only needs to be placed on one adhering surface and so requires less adhesive than a cold seal adhesive. Furthermore, a heat seal adhesive does not adhere, or become 'sticky', until heat is applied. Therefore, the hot seal adhesive is less likely to cause complications during manufacture of the inner pack.

Figure 19:
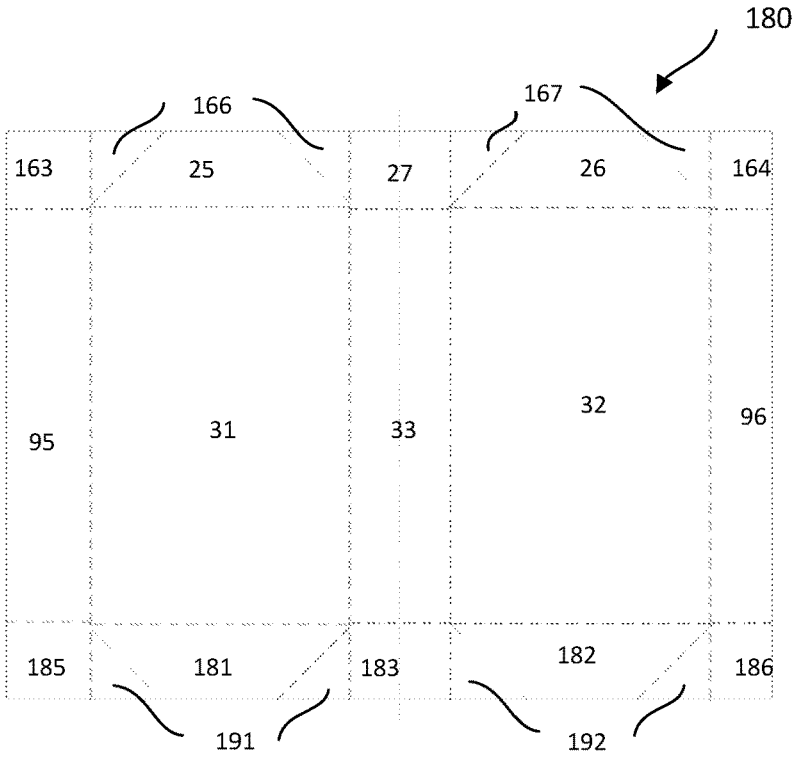
FIG. 19 shows a schematic top view of a blank for forming an inner pack of a package.

Referring to FIG. 19, a blank 180 for forming an inner pack 20, 60, 90, 120, 130 is shown. When the blank 160 is assembled into an inner pack, the inner pack comprises opposing first and second side walls 31, 32, and opposing third and fourth side walls 33, 34. The fourth side wall 34 comprises an outer flap 95, and an inner flap 96 which are adhered together to form the fourth side wall 34. The outer flap 95 of the fourth side wall 34 extends from a longitudinal edge of the first side wall 31 and the inner flap 96 of the fourth side wall 34 extends from a longitudinal edge of the second side wall 32.

The first end wall 22 of the inner pack further comprises a third flap 27 extending from the proximal end of the third side wall 33. The first end wall 22 of the inner pack further comprises a fourth flap 28 extending from the proximal end of the fourth side wall 34. The fourth flap 28 comprises an outer flap 163 extending from the proximal end of the outer flap 95 of the fourth side wall 34 and an inner flap 164 extending from the proximal end of the inner flap 96 of the fourth side wall 34. The outer flap 163 and the inner flap 164 of the fourth flap 28 of the first end wall 22 are adhered together to form the fourth flap 28.

In addition, the inner pack of FIG. 19 comprises folding portions 166 that connect the first flap 25 of the first end wall 22 to the third and fourth flaps 27, 28 of the first end wall 22 and folding portions 167 that connect the second flap 26 of the first end wall 22 to the third and fourth flaps 27, 28 of the first end wall 22. The folding portions 166 form a part of the first flap 25 of the first end wall 22 and the folding portions 167 form a part of the second flap 26 of the first end wall 22. In the present embodiment, a folding portion 166 connects the first flap 25 to the third flap 27 of the first end wall 22 and a folding portion 166 connects the first flap 25 to the outer flap 163 of the fourth flap 28 of the first end wall 22. Also, a folding portion 167 connects the second flap 26 to the third flap 27 of the first end wall 22 and a folding portion 167 connects the second flap 26 to the inner flap 164 of the fourth flap 28 of the first end wall 22.

In FIG. 19, when the blank 180 is assembled into an inner pack, the second end wall 23 of the inner pack comprises a first flap 181 extending from the distal end of the first side wall 31, and a second flap 182 extending from a distal end of the second side wall 32. The first flap 181 and the second flap 182 being adhered together to form the second end wall 23.

In FIG. 19, when the blank 180 is assembled into an inner pack, the second end wall 23 of the inner pack further comprises a third flap 183 extending from the distal end of the third side wall 33 and a fourth flap extending from the distal end of the fourth side wall 34. The fourth flap 184 comprises an outer flap 185 extending from the distal end of the outer flap 95 of the fourth side wall 34 and an inner flap 186 extending from the distal end of the inner flap 96 of the fourth side wall 34. The outer flap 185 and the inner flap 186 are adhered together to form the fourth flap 184 of the second end wall 23.

In addition, the inner pack of FIG. 19 comprises folding portions 191 that connect the first flap 181 of the second end wall 23 to the third and fourth flaps 183, 184 of the second end wall 23 and folding portions 192 that connect the second flap 182 of the second end wall 23 to the third and fourth flaps 183, 184 of the second end wall 23. The folding portions 191 form a part of the first flap 181 of the second end wall 23 and the folding portions 192 form a part of the second flap 182 of the second end wall 23. In the present embodiment, a folding portion 191 connects the first flap 181 to the third flap 183 of the second end wall 23 and a folding portion 191 connects the first flap 181 to the outer flap 185 of the fourth flap 184 of the second end wall 23. Also, a folding portion 192 connects the second flap 182 to the third flap 183 of the second end wall 23 and a folding portion 192 connects the second flap 182 to the inner flap 186 of the fourth flap 184 of the second end wall 23.

Therefore, as previously described, the inner pack comprises a first flap 25 and a second flap 26 of the first end wall 22, a first flap 181 and a second flap 182 of the second end wall 23, a first side wall 31, a second side wall 32, and a third side wall 33. The inner pack also comprises a fourth side wall 34 formed by an outer flap 95 and an inner flap 96. The inner pack also comprises third flap 27 of the first end wall 22 and fourth flap 28 of the first end wall 22 formed by an outer 163 and an inner flap 164.

The inner pack also comprises third flap 183 of the second end wall 23 and fourth flap 184 of the second end wall 23 formed by an outer 185 and an inner flap 186. The inner pack also comprises folding portions 166 of the first flap 25 of the first end wall 22 and folding portions 167 of the second flap 26 of the first end wall 22. The inner pack also comprises folding portions 191 of the first flap 181 of the second end wall 23 and folding portions 192 of the second flap 192 of the second end wall 23.

Figure 20:
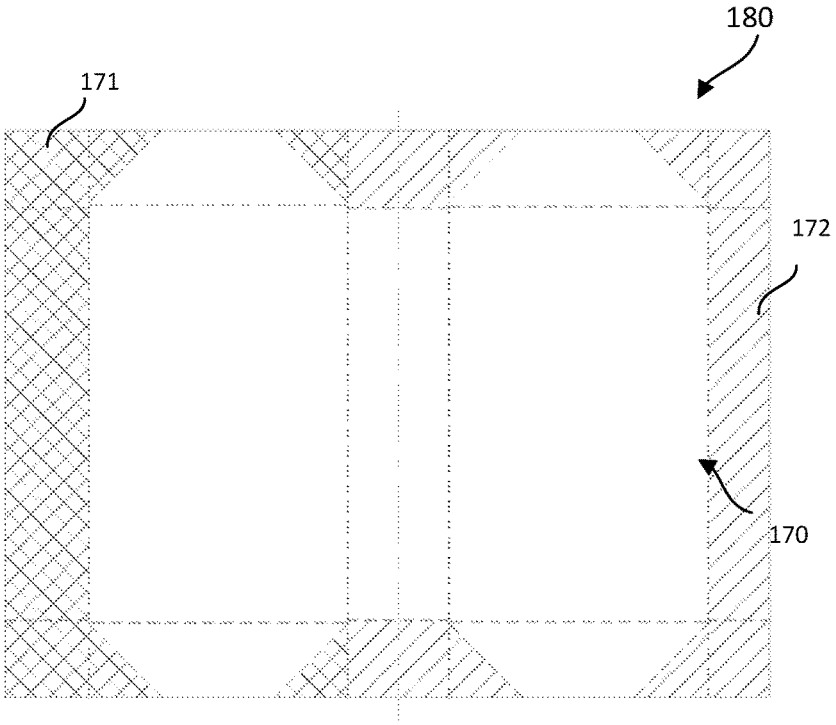
FIG. 20 shows a schematic top view of a blank for forming an inner pack of a package with a glue pattern applied.

Referring to FIG. 20, in the present embodiment, the first area of adhesive 171 is located on the inner surface of the first flap 25 of the first end wall 22, the first flap 181 of the second end wall 23, and an outer flap 95 of the fourth side wall 34. Furthermore, in the present embodiment, the second area of adhesive 172 is located on the outer surface of the inner flap 96 of the fourth side wall 34, and the second flaps 26, 182 and the third flaps 27, 183 of the first and second end walls 22, 23.

In the present embodiment, the adhesive 170 on the first flaps 25, 181 and on the second flaps 26, 182 of the first and second end walls 22, 23 is only located on the folding portions 166, 167, 191, 192.

In the present embodiment, the adhesive 170 is a cold seal adhesive. The cold seal adhesive may be, for example, but not limited to, an adhesive derived from natural rubber, latex, resin, PVA, Loctite Liofol CS. The cold seal adhesive may be chosen to match the required properties. The cold seal adhesive may be extrudable, water based, or solvent based with pealability, reclosability, or permanent seal. Cold seal adhesives are generally easy to process with high printing speeds, have long shelf life on reels of sheet material, are recyclable once applied to sheet material, and are approved for direct food contact. A cold seal adhesive is placed on both adhering surfaces and only requires contact and/or pressure to adhere together to form a seal. That is, a cold seal adhesive does not require heat to activate the adhesive.

Figure 21:
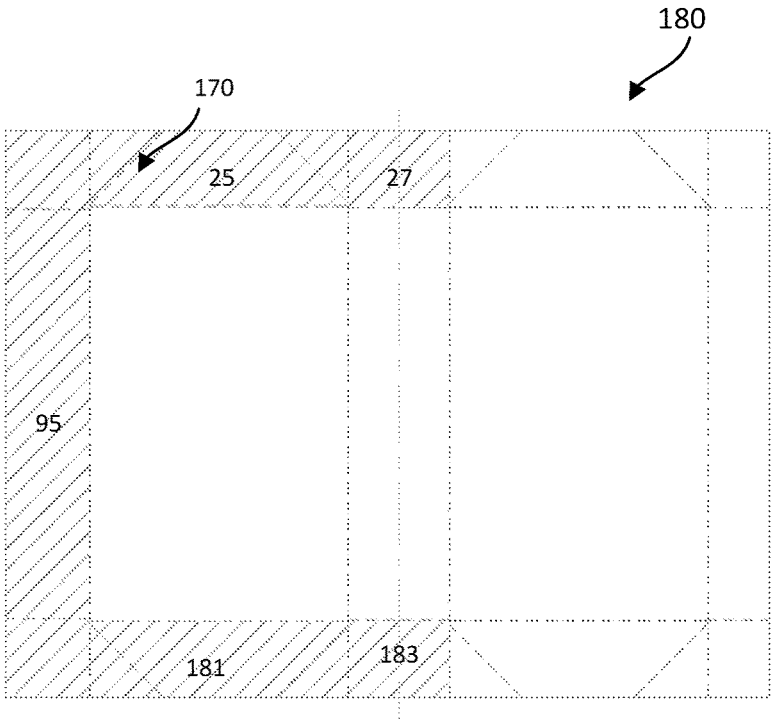
FIG. 21 shows a schematic top view of a blank for forming an inner pack of a package with a glue pattern applied.

Referring to FIG. 21, an area of adhesive is located on the inner surface of the first flaps 25, 181 of the first and second end walls 22, 23, the outer flap 95 of the fourth side wall 34, and the third flaps 27, 183 of the first and second end walls 22, 23.

In the present embodiment, the adhesive 170 is a heat seal adhesive. The heat seal adhesive may be, for example, but not limited to, adhesives based on polypropylene (PP), polyethylene (PE), and polyethylene terephthalate (PET) plastics, Loctite Liofol HS 2809-22 RE, or cellulosic coatings. Heat seal adhesives based on PP, PE, and PET plastics have low sealing temperatures. A cellulosic coating can be used as a heat seal solution and is also recyclable. A heat seal adhesive only needs to be placed on one adhering surface and so requires less adhesive than a cold seal adhesive. Furthermore, a heat seal adhesive does not adhere, or become 'sticky', until heat is applied. Therefore, the hot seal adhesive is less likely to cause complications during manufacture of the inner pack.

In some embodiments, the package 10, 1100 for an aerosol provision system component or article comprises a container 11 and an inner pack 20, 60, 90, 120, 130, 160, 190 located within the container 11. The inner pack comprises a sheet material 21 that is arranged to form the inner pack. In embodiments, the sheet material 21 comprises at least 90% of a first material, and in embodiments has a water vapour permeability of less than 6 g/m2/24 hr.

The large percentage of a single material increases the likelihood of the material being easily recyclable. Furthermore, the low water vapour permeability prevents water vapour from passing through the sheet material such that the inner pack can keep its contents fresher for longer.

In some embodiments, the sheet material comprises at least 92.5% of the first material. In other embodiments, the sheet material comprises at least 95% of the first material. In yet further embodiments, the sheet material comprises at least 98.5% of the first material. In some embodiments the percentage of the first material is calculated based on the mass of the first material and the sheet material.

Preferably, the water vapour permeability of the first material is less than 5 g/m2/24 hr, more preferably, less than 3 g/m2/24 hr, and even more preferably, less than 1 g/m2/24 hr. The lower the water vapour permeability of the first material, the longer the components or articles within the inner pack can be kept fresh.

Preferably, the sheet material is recyclable. Preferably, the first material is compostable. Preferably the first material is a non-plastic material. The first material may be, for example, but not limited to, paper.

In the present embodiment, and those described above in relation to FIGS. 1 to 23, the adhesive used may comprise adhesives selected from a solvent based adhesive, a polyurethane based adhesive, a cyanoacrylate based adhesive, a natural rubber based adhesive, a latex based adhesive, a resin based adhesive, a cellulose based adhesive, a polypropylene ("PP") based adhesive, a polyethylene ("PE") based adhesive, a polyethylene terephthalate ("PET") based adhesive, and a polyvinyl alcohol ("PVA") based adhesive. Each of these adhesives may be used to provide either a "permanent" or "resealable" adhesive.

In embodiments in which the first material is paper, preferably a paper suitable adhesive is used. A paper suitable adhesive is preferably selected from at least one of (or a combination of one or more of) a natural rubber based adhesive, a latex based adhesive, a resin based adhesive, a cellulose based adhesive, a polypropylene ("PP") based adhesive, a polyethylene ("PE") based adhesive, a polyethylene terephthalate ("PET") based adhesive, and a polyvinyl alcohol ("PVA") based adhesive. These adhesives may provide a particularly advantageous adhesion when applied to paper.

In particular, an adhesive which is based on natural rubber, latex, resin, or cellulose may produce markedly less emissions when produced than a synthetic adhesive. As such, these adhesives may be applied to a paper inner pack for example formed from reconstituted paper material to arrive at an inner pack with a minimal emissions footprint.

In relation to any of the embodiments described above, a permanent or resealable adhesive may be based on any of the forgoing adhesives, depending upon the composition and application of the adhesive. It has been found that PVA is advantageous as a permanent adhesive when the first material is paper, due to its interaction with the moisture content of the paper.

In some embodiments, the inner pack may further comprise a second material. The second material maybe metallic. The first and second material may be arranged in layers to form the sheet material of the inner pack. In some embodiments, the first and second layers are laminated. Preferably, the second material which forms the second layer is applied to the first material which forms the first layer as a coating. The metallic material layer may protect the paper layer from breaking.

In some embodiments, the container may comprises at least 90% of the first material. Furthermore, due to the low water vapour permeability of the first material, the container can form the outer layer of the package. This removes the need for a plastic outer wrap because the water vapour cannot pass through the inner pack and/or container due to first material and the inner pack being sealed.

A package for an aerosol provision system component or article can be provided by providing a sheet material that comprises at least 90% of a first material and has a water vapour permeability of less than 6 g/m2/24 hr, arranging the sheet material to form an inner pack, and locating the inner pack within a container. In embodiments, these properties may be provided by using a first material which is paper.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in the future.

The invention claimed is:

1. A package for an aerosol provision system component or article, the package comprising:

a container with an access; and an inner pack located within the container such that the inner pack can be accessed via the access;

the inner pack comprising a sheet material that is arranged to form the inner pack;

wherein the inner pack comprises a first end wall proximate to the access and a second end wall distal to the access longitudinally distant from the first end wall, the first end wall comprising first and second end flaps of the sheet material which extend from opposing sides of the first end wall, and wherein the first and second end flaps of sheet material are secured in position by an adhesive configured to seal the inner pack, wherein the first flap comprises a first part and a second part, the first part being secured to the second flap and the second part being unsecured to the second flap, the second part being configured to be pulled by a user to at least partially separate the portion of the sheet material from the remainder of the sheet material to allow access to the inside of the inner pack, and wherein the first flap comprises a fold line defining one end of the first flap, and the first part of the first flap is located between the fold line and the second part of the first flap such that the second part forms a free end of the first flap.

2. The package according to claim 1, wherein the first flap is larger than the second flap such that the first flap is configured to extend substantially over the first end wall of the pack towards the opposing side of the first end wall such that the first flap overlaps substantially all of the second flap.

3. The package according to claim 2, wherein the distance between the first flap and the opposing side wall is smaller than the distance between the second flap and its opposing side wall.

4. The package according to claim 1, wherein the first flap further comprises a tab which extends from the free end of the second part of the first flap, the tab being configured to be pulled by a user to open the inner pack.

5. The package according to claim 1, wherein the tab comprises indicia configured to provide information to a consumer in relation to how to unseal the inner pack to gain access to the inner pack.

6. The package according to claim 1, wherein an end of the second flap of the inner pack comprises a cut-out which corresponds to the tab located on the free end of the first flap.

7. The package according to claim 1, wherein the first part of the first flap is sealed to the second flap by a resealable adhesive.

8. The package according to claim 1, wherein the inner pack comprises a plurality of side walls extending between the first end wall and the second end wall.

9. The package according to claim 8, wherein the inner pack comprises opposing first and second side walls, and opposing third and fourth side walls, wherein the fourth side wall comprises an outer flap extending from a longitudinal edge of the first side wall and an inner flap extending from a longitudinal edge of the second side wall, the outer flap and inner flap being adhered together to form the fourth side wall.

10. The package according to claim 9, wherein the first end wall of the inner pack comprises a third flap extending from the proximal end of the third side wall and a fourth flap extending from the proximal end of the fourth side wall, the fourth flap comprising an outer flap extending from the proximal end of the outer flap of the fourth side wall and an inner flap extending from the proximal end of the inner flap of the fourth side wall, the outer flap and inner flap of the fourth flap of the first end wall being are adhered together.

11. The package according to claim 10, wherein the inner pack further comprises folding portions that connect the first flap of the first end wall to the third and fourth flaps of the first end wall, and folding portions that connect the second flap of the first end wall to the third and fourth flaps of the first end wall.

12. The package according to claim 10, wherein the second end wall of the inner pack comprises a third flap extending from the distal end of the third side wall and a fourth flap extending from the distal end of the fourth side wall, the fourth flap comprising an outer flap extending from the distal end of the outer flap of the fourth side wall and an inner flap extending from the distal end of the inner flap of the fourth side wall, the outer flap and inner flap of the fourth flap of the second end wall being adhered together.

13. The package according to claim 10, wherein the third side wall comprises an outer flap extending from a longitudinal edge of the first side wall and an inner flap extending from a longitudinal edge of the second side wall, the outer flap and inner flap being adhered together to form the third side wall.

14. The package according to claim 13, wherein the third flap comprises an outer flap extending from the proximal end of the outer flap of the third side wall and an inner flap extending from the proximal end of the inner flap of the third side wall, the outer flap and inner flap of the third flap of the first end wall being are adhered together.

15. The package according to claim 9, wherein the second end wall comprises a first flap extending from the distal end of the first side wall and a second flap extending from a distal end of the second side wall, the first flap and second flap of the second end wall being adhered together.

16. The package according to claim 15, wherein the inner pack further comprises folding portions that connect the first flap of the second end wall to the third and fourth flaps of the second end wall, and folding portions that connect the second flap of the second end wall to the third and fourth flaps of the second end wall.

17. The package according to claim 16, wherein the first area of adhesive is located on the inner surface of the folding portions of the first and second end walls, and the outer flap of the fourth side wall, and the second area of adhesive is located on the outer surface of the inner flap of the fourth side wall and the third flaps and the folding portions of the first and second end walls.

18. The package according to claim 9, wherein the second end wall comprises first and second tabs extending from side edges of the second end wall and folding portions which connect the first and second tab of the second end wall to the third and fourth side walls.

19. The package according to claim 18, wherein the first area of adhesive forms a continuous area of adhesive over the inner surface of the first flap and outer flaps of the third and fourth flaps of the first end wall, and the outer flaps of the third and fourth side walls, and the second area of adhesive forms a continuous area of adhesive over the outer surface of the second flap of the first end wall, the inner flaps of the third and fourth flaps of the first end wall, the inner flaps of the third and fourth side wall, and the first and second tabs of the second end wall.

20. The package according to claim 9, wherein the inner pack is formed from a blank of sheet material comprising an adhesive to secure the flaps together, the adhesive comprising a first area of adhesive located on the outer flaps of the blank and a second area of adhesive located on the inner flaps of the blank.

21. The package according to claim 20, wherein the first area of adhesive is located on the inner surface of the outer flaps and the second area of adhesive is located on the outer surface of the inner flaps, the first and second areas of adhesive being positioned such that when the inner pack is in an assembled state the first and second areas of adhesive contact each other.

22. The package according to claim 20, wherein the second area of adhesive is located on the outer surface of the inner flaps of the third and fourth flaps of the second end wall, the inner flaps of the third and fourth side walls, and the second flap of the first end wall.

23. The package according to claim 22, wherein the first area of adhesive is located on folding portions of the first flap of the first end wall and folding portions of the outer flaps of the third and fourth side walls.

24. The package according to claim 20, wherein the first area of adhesive is located on the inner surface of the first flaps of the first and second end walls, the outer flap of the fourth side wall, the outer flaps of the fourth flap of the first and second end walls, and the third flaps of the first and second end walls.

25. The package according to claim 9, wherein the adhesive is a cold seal adhesive.

26. The package according to claim 9, wherein the adhesive is a heat seal adhesive.

27. The package according to claim 1, wherein the inner pack is hermetically sealed.

28. The package according to claim 1, wherein the container comprises a flip lid.

29. The package according to claim 1, wherein the sheet material has a basis weight of less than or equal to 75 grams per square metre.

30. The package according to claim 1, wherein the sheet material of the inner pack comprises at least 90% of a first material (by mass).

31. The package according to claim 1, wherein the sheet material of the inner pack comprises a first material which has a water vapour permeability of less than 6 grams per metre squared per 24 hours.

32. A method of manufacturing the package according to claim 1, the method comprising:

providing a sheet material;

arranging the sheet material to form an inner pack having first and second walls, wherein the first wall comprises first and second end flaps of the sheet material that are secured in position by an adhesive; and locating the inner pack within a container having an access and the second wall is distal to the access.

* * * * *